US012085319B2

(12) United States Patent
Tsuka et al.

(10) Patent No.: US 12,085,319 B2
(45) Date of Patent: Sep. 10, 2024

(54) COMPRESSOR WITH WELDING PIN CONNECTION

(71) Applicant: DAIKIN INDUSTRIES, LTD., Osaka (JP)

(72) Inventors: Yoshitomo Tsuka, Osaka (JP); Sayumi Nishikawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 18/240,539

(22) Filed: Aug. 31, 2023

(65) Prior Publication Data

US 2023/0408155 A1 Dec. 21, 2023

Related U.S. Application Data

(63) Continuation of application No. PCT/JP2022/006704, filed on Feb. 18, 2022.

(30) Foreign Application Priority Data

Mar. 1, 2021 (JP) ..... 2021-031621

(51) Int. Cl.
*F25B 31/02* (2006.01)
*F04C 18/02* (2006.01)

(52) U.S. Cl.
CPC ..... *F25B 31/026* (2013.01); *F04C 18/0215* (2013.01); *F04C 2240/30* (2013.01); *F04C 2250/00* (2013.01)

(58) Field of Classification Search
CPC ..... F25B 31/026; F25B 2400/13; F25B 2400/23; F04C 18/0215; F04C 2240/30;

(Continued)

(56) References Cited

U.S. PATENT DOCUMENTS 5,176,506 A * 1/1993 Siebel ..... F04B 39/16 418/94
5,547,355 A 8/1996 Watanabe et al.
2004/0062670 A1 4/2004 Matsukawa et al.
(Continued)

FOREIGN PATENT DOCUMENTS

CN 1542281 A 11/2004
CN 102046979 A * 5/2011 ..... F01C 21/007
(Continued)

OTHER PUBLICATIONS

Translation EP-1998047-A1 (Year: 2024).*
(Continued)

*Primary Examiner* — J. Todd Newton
(74) *Attorney, Agent, or Firm* — Global IP Counselors, LLP

(57) ABSTRACT

A compressor includes an actuator, a compression mechanism, a drive shaft, a support, a casing, and a welding pin. The drive shaft transmits a driving force of the actuator to the compression mechanism. The support supports a bearing that rotatably supports the drive shaft. The support has at least one hole formed in an outer surface. The casing has a cylindrical shape and accommodates the drive shaft and the support. The welding pin is press-fitted into the hole of the support and is welded and fixed to the casing. A low rigidity region is provided at at least a part of a periphery of an adjacent portion adjacent to the hole of the support. The low rigidity region has lower rigidity than the adjacent portion. The low rigidity region includes a thin portion having a smaller thickness in a radial direction of the casing than the adjacent portion.

17 Claims, 8 Drawing Sheets

(58) Field of Classification Search
CPC ..... F04C 2250/00; F04C 18/02; F04C 29/00; F04B 39/121
USPC ..... 418/55.1
See application file for complete search history.

(56) References Cited

U.S. PATENT DOCUMENTS

| | | | | |
|---|---|---|---|---|
| 2009/0038150 | A1* | 2/2009 | Kishikawa | F04B 39/121 219/121.85 |
| 2010/0196185 | A1* | 8/2010 | Higuchi | F04C 29/06 418/59 |
| 2022/0065250 | A1* | 3/2022 | Nagahara | F04C 18/0215 |
| 2022/0065251 | A1* | 3/2022 | Nagahara | F04B 39/121 |
| 2023/0204031 | A1* | 6/2023 | Nishikawa | F04C 23/008 418/55.1 |

FOREIGN PATENT DOCUMENTS

| | | | | | |
|---|---|---|---|---|---|
| CN | 103807170 | A | | 5/2014 | |
| CN | 104343688 | A | | 2/2015 | |
| CN | 105090033 | A | * | 11/2015 | |
| EP | 1998047 | A1 | * | 12/2008 | B23K 26/282 |
| JP | 4-232396 | A | | 8/1992 | |
| JP | 6-66274 | A | | 3/1994 | |
| JP | 2003-293975 | A | | 10/2003 | |
| JP | 2017-25762 | A | | 2/2017 | |
| JP | 2020-190218 | A | | 11/2020 | |
| KR | 10-2007-0072091 | A | | 7/2007 | |
| WO | 2007/102462 | A1 | | 9/2007 | |

OTHER PUBLICATIONS

Translation CN-102046979-A (Year: 2024).*
Translation CN-105090033-A (Year: 2024).*
International Preliminary Report of corresponding PCT Application No. PCT/JP2022/006704 dated Sep. 14, 2023.
International Search Report of corresponding PCT Application No. PCT/JP2022/006704 dated Apr. 19, 2022.
European Search Report of corresponding EP Application No. 22 76 3012.6 dated Jul. 30, 2024.

* cited by examiner

COMPRESSOR WITH WELDING PIN CONNECTION

CROSS-REFERENCE TO RELATED APPLICATIONS

This is a continuation of International Application No. PCT/JP2022/006704 filed on Feb. 18, 2022, which claims priority to Japanese Patent Application No. 2021-031621, filed on Mar. 1, 2021. The entire disclosures of these applications are incorporated by reference herein.

BACKGROUND

Technical Field

The present disclosure relates to a compressor and a refrigeration cycle apparatus including the compressor. Specifically, the present disclosure relates to a compressor in which a welding pin is press-fitted into a hole on an outer surface of a support that supports a bearing, and the welding pin and a casing are welded and fixed to each other, and a refrigeration cycle apparatus including the compressor.

Background Art

Conventionally, as in JP 2017-25762A, a compressor is known in which a welding pin is press-fitted into a hole formed on an outer surface of a support that supports a bearing, and the welding pin and a casing are welded to fix the support to the casing.

SUMMARY

A compressor according to an aspect includes an actuator, a compression mechanism, a drive shaft, a support, a casing, and a welding pin. The drive shaft transmits a driving force of the actuator to the compression mechanism. The support supports a bearing that is configured to rotatably support the drive shaft. At least one hole is formed in an outer surface of the support. The casing accommodates the drive shaft and the support therein. The casing has a cylindrical shape. The welding pin is press-fitted into the hole of the support and is welded and fixed to the casing. A low rigidity region is provided at least a part of a periphery of an adjacent portion adjacent to the hole of the support. The low rigidity region has lower rigidity than the adjacent portion. The low rigidity region includes a thin portion having a smaller thickness in a radial direction of the casing than the adjacent portion.

DETAILED DESCRIPTION OF EMBODIMENT(S)

An embodiment of a compressor will be described below with reference to the drawings.

The following description may include expressions such as "up" and "down" to describe positions and orientations for convenience of description. Unless otherwise noted, the positions and the orientations represented by the expressions such as "up" and "down" follow arrows in figures.

Also, in the following description, expressions such as "parallel", "orthogonal", "horizontal", "vertical", and "identical" may be used, but these expressions do not necessarily mean parallel, orthogonal, horizontal, vertical, and identical in a strict meaning. The meanings of the expressions such as "parallel", "orthogonal", "horizontal", "vertical", and "identical" include substantially parallel, orthogonal, horizontal, vertical, and identical when these expressions are used.

(1) Overall Configuration

Figure 1:
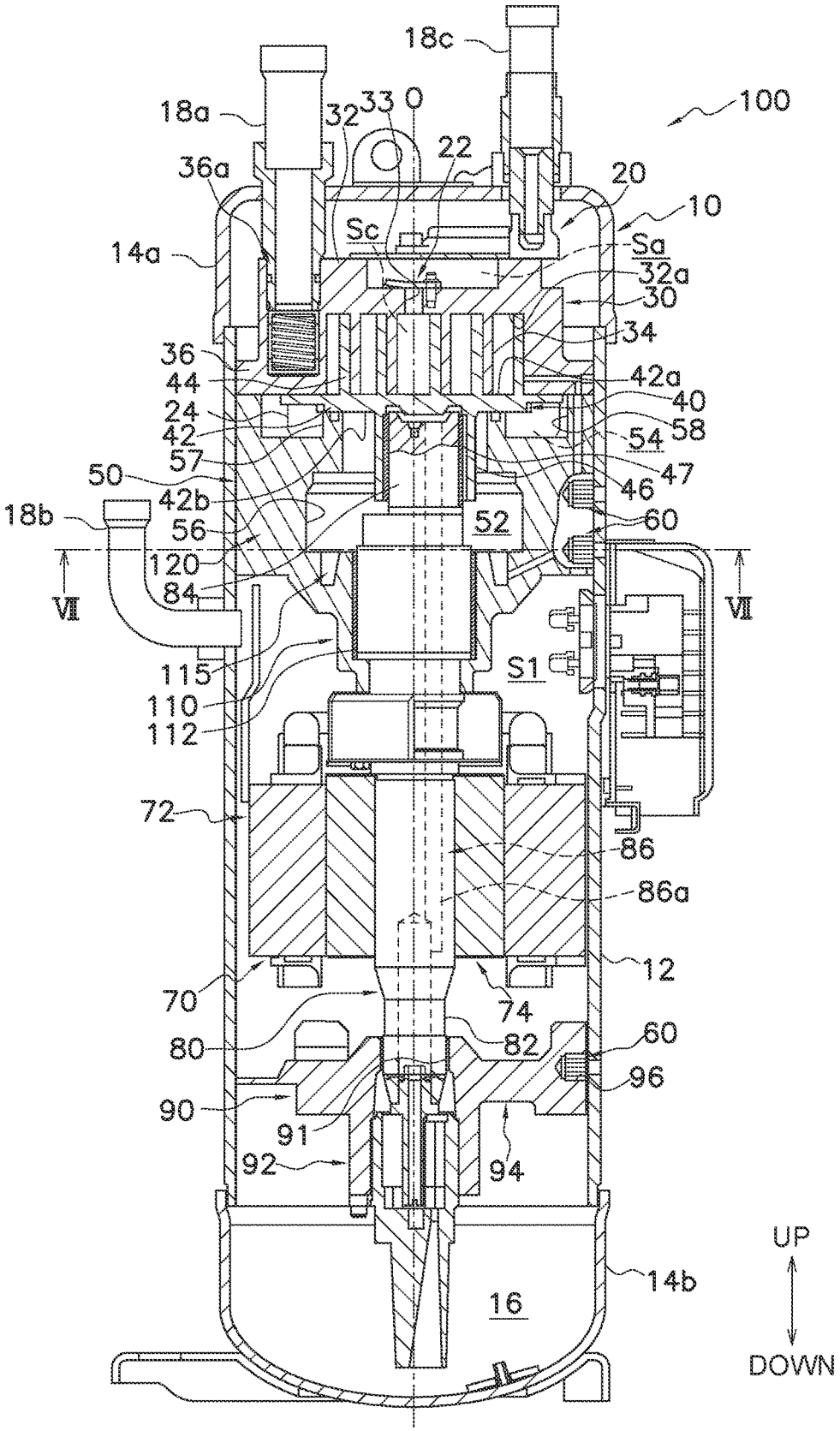
FIG. 1 is a schematic longitudinal cross-sectional view of a scroll compressor according to one embodiment of the present disclosure.

An outline of a scroll compressor 100 as an embodiment of a compressor of the present disclosure will be described with reference to FIG. 1. FIG. 1 is a schematic longitudinal cross-sectional view of the scroll compressor 100.

The scroll compressor 100 is used in a refrigeration cycle apparatus 1 using a vapor compression refrigeration cycle such as an air conditioner, a hot water supply apparatus, and a floor heating device. For example, the scroll compressor 100 is mounted in a heat source unit of the refrigeration cycle apparatus 1, and constitutes a part of a refrigerant circuit of the refrigeration cycle apparatus 1.

Figure 10:
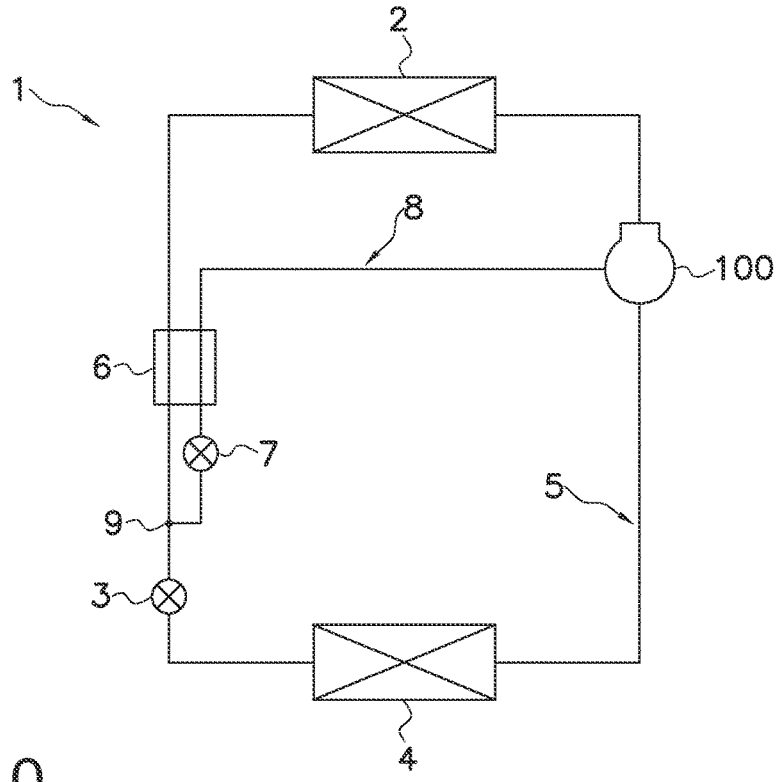
FIG. 10 is a schematic configuration diagram of a refrigeration cycle apparatus including the scroll compressor in FIG. 1.

The refrigeration cycle apparatus 1 includes, for example, a refrigerant circuit 5 as illustrated in FIG. 10. The refrigerant circuit 5 mainly includes the scroll compressor 100, a condenser (radiator) 2, an expansion device 3, and an evaporator 4. In the refrigerant circuit 5, the scroll compressor 100, the condenser 2, the expansion device 3, and the evaporator 4 are connected by pipes as illustrated in FIG. 10. The condenser 2 and the evaporator 4 are heat exchangers. For example, the expansion device 3 may be an electric expansion valve whose opening degree is variable or a capillary tube.

As an optional configuration, in the present embodiment, the refrigerant circuit 5 includes a subcooling heat exchanger 6 and a bypass expansion device 7. The subcooling heat exchanger 6 is a heat exchanger in which a refrigerant flowing through a bypass pipe 8 and a refrigerant flowing through the refrigerant circuit 5 from the condenser 2 to the expansion device 3 exchange heat. The bypass pipe 8 is a pipe connecting a branch portion 9, on a pipe connecting the condenser 2 and the expansion device 3 in the refrigerant circuit 5, and a below-mentioned injection pipe 18*c* of the scroll compressor 100. The bypass expansion device 7 is, for example, an electric expansion valve whose opening degree is variable. The refrigerant flowing through the refrigerant circuit 5 from the condenser 2 to the expansion device 3 is cooled by heat exchange performed in the subcooling heat exchanger 6, becomes a refrigerant in a subcooled state, and flows to the expansion device 3. The refrigerant that has flowed through the bypass pipe 8, has been decompressed to an intermediate pressure in a refrigeration cycle (pressure between high and low pressure in the refrigeration cycle, hereinbelow sometimes simply referred to as an intermediate pressure) in the bypass expansion device 7, and has been subjected to heat exchange with the refrigerant flowing through the subcooling heat exchanger 6 from the condenser 2 to the expansion device 3 is injected into a below-mentioned compression mechanism 20 of the scroll compressor 100.

In the refrigerant circuit 5, the scroll compressor 100 sucks a gas refrigerant having a low pressure in the refrigeration cycle (hereinbelow sometimes simply referred to as a low pressure) and compresses the gas refrigerant in the compression mechanism 20. The gas refrigerant having a high pressure in the refrigeration cycle (hereinbelow sometimes simply referred to as a high pressure) compressed in the compression mechanism 20 and discharged from the scroll compressor 100 radiates heat and condenses in the condenser 2 to become a high-pressure liquid refrigerant. The refrigerant condensed in the condenser 2 flows to the expansion device 3. Part of the refrigerant flowing from the condenser 2 toward the expansion device 3 flows through the bypass pipe 8, is decompressed to the intermediate pressure by the bypass expansion device 7, cools the refrigerant flowing toward the expansion device 3 in the subcooling heat exchanger 6, and is then injected into the compression mechanism 20 of the compressor 100. The refrigerant that has passed through the subcooling heat exchanger 6 and flowed to the expansion device 3 is decompressed in the expansion device 3 and becomes a gas-liquid two-phase refrigerant having a low pressure in the refrigeration cycle (hereinbelow sometimes simply referred to as a low pressure). The low-pressure gas-liquid two-phase refrigerant, having flowed through the subcooling heat exchanger 6 and decompressed in the expansion device 3, absorbs heat in the evaporator 4 and evaporates to become a low-pressure gas refrigerant. The low-pressure gas refrigerant that has exited the evaporator 4 is sucked into the scroll compressor 100 again and compressed.

For example, in a case where the refrigeration cycle apparatus 1 is an air conditioner, during cooling operation, a heat exchanger mounted on a utilization unit functions as the evaporator 4 and a heat exchanger mounted on a heat source unit functions as the condenser 2. Whereas, during heating operation, the heat exchanger mounted on the utilization unit functions as the condenser 2 and the heat exchanger mounted on the heat source unit functions as the evaporator 4. In a case where the refrigeration cycle apparatus 1 is an air conditioner and the air conditioner is used for both cooling and heating, the refrigeration cycle apparatus 1 further includes a flow path switching mechanism (not illustrated) such as a four-way switching valve to be used to switch between cooling operation and heating operation.

The scroll compressor 100 of the present disclosure is a fully hermetic compressor. As described above, the scroll compressor 100 sucks the low-pressure refrigerant, compresses the sucked refrigerant into a high-pressure refrigerant in the refrigeration cycle, and discharges the high-pressure refrigerant. The refrigerant is, for example, an HFC refrigerant R32. Note that R32 is merely an example of the refrigerant, and the scroll compressor 100 may be a device that compresses one or more HFC refrigerant other than R32 or one or more HFO refrigerant. Also, for example, the scroll compressor 100 may be a device that compresses and discharges a natural refrigerant such as carbon dioxide.

As illustrated in FIG. 1, the scroll compressor 100 mainly includes a casing 10, the compression mechanism 20, a housing 50, a welding pin 60, a motor 70, a drive shaft 80, and a lower bearing housing 90.

(2) Detailed Configuration

Details of the casing 10, the compression mechanism 20, the housing 50, the welding pin 60, the motor 70, the drive shaft 80, and the lower bearing housing 90 will be described.

(2-1) Casing

The scroll compressor 100 includes the casing 10 having a longitudinally elongated cylindrical shape (refer to FIG. 1).

The casing 10 mainly includes a cylindrical member 12, an upper lid 14*a*, and a lower lid 14*b*. The cylindrical member 12 is a cylindrical member extending along a center axis O and opened on upper and lower sides. The upper lid 14*a* is provided on an upper side of the cylindrical member 12 and closes an upper opening of the cylindrical member 12. The lower lid 14*b* is provided on the lower side of the cylindrical member 12 and closes a lower opening of the cylindrical member 12. The cylindrical member 12, the upper lid 14*a*, and the lower lid 14*b* are fixed by welding to maintain a hermetic state.

The casing 10 houses therein various members constituting the scroll compressor 100 including the compression mechanism 20, the housing 50, the motor 70, the drive shaft 80, and the lower bearing housing 90 (refer to FIG. 1). The compression mechanism 20 is disposed in an upper part of the casing 10. The housing 50 is disposed below the compression mechanism 20. The motor 70 is disposed below the housing 50. The lower bearing housing 90 is disposed below the motor 70. An oil reservoir space 16 is formed in a bottom part of the casing 10. Refrigerator oil for lubricating various sliding portions of the scroll compressor 100 is stored in the oil reservoir space 16.

The motor 70 is disposed in a first space S1 of the scroll compressor 100. In the scroll compressor 100 of the present embodiment, the first space S1 is a space into which a high-pressure refrigerant compressed by the compression mechanism 20 flows. In other words, the scroll compressor 100 of the present embodiment is a so-called high-pressure dome-type scroll compressor. The first space S1 communicates with the oil reservoir space 16 in a lower part of the casing 10 via a gap or the like formed between the cylindrical member 12 of the casing 10 and a below-mentioned stator 72 of the motor 70 (refer to FIG. 1).

Note that the scroll compressor 100 does not need to be is a high-pressure dome-type scroll compressor. For example, the compressor of the present disclosure may be a so-called low-pressure dome-type scroll compressor in which a motor is disposed in a space into which a low-pressure refrigerant flows from the refrigerant circuit 5 of the refrigeration cycle apparatus 1.

A suction pipe 18*a*, a discharge pipe 18*b*, and the injection pipe 18*c* are attached to the casing 10 so that an inside of the casing 10 communicate with an outside of the casing 10 via these pipes (refer to FIG. 1).

As illustrated in FIG. 1, the suction pipe 18*a* is provided to penetrate the upper lid 14*a* of the casing 10. One end (an end portion outside the casing 10) of the suction pipe 18*a* is connected to a pipe extending from the evaporator 4 of the refrigerant circuit 5 of the refrigeration cycle apparatus 1, and the other end (an end portion inside the casing 10) of the suction pipe 18*a* is connected to a suction port 36*a* of a fixed scroll 30 of the compression mechanism 20. The suction pipe 18*a* communicates with a below-mentioned compression chamber Sc on an outer peripheral side of the compression mechanism 20 via the suction port 36*a*. The scroll compressor 100 sucks a low-pressure refrigerant in the refrigeration cycle of the refrigeration cycle apparatus 1 via the suction pipe 18*a*.

As illustrated in FIG. 1, the discharge pipe 18*b* is provided at a center of the cylindrical member 12 in an up-down direction so as to penetrate the cylindrical member 12. One end (an end portion outside the casing 10) of the discharge pipe 18*b* is connected to a pipe extending to the condenser 2 of the refrigerant circuit 5 of the refrigeration cycle apparatus 1, and the other end (an end portion inside the casing 10) of the discharge pipe 18*b* is disposed between the housing 50 and the motor 70 in the first space S1. The scroll compressor 100 discharges a high-pressure refrigerant compressed by the compression mechanism 20 via the discharge pipe 18*b*.

As illustrated in FIG. 1, the injection pipe 18*c* is provided to penetrate the upper lid 14*a* of the casing 10. One end (an end portion outside the casing 10) of the injection pipe 18*c* is connected to the bypass pipe 8 of the refrigerant circuit 5 of the refrigeration cycle apparatus 1, and the other end (an end portion inside the casing 10) of the injection pipe 18*c* is connected to the fixed scroll 30 of the compression mechanism 20. The injection pipe 18*c* communicates with the compression chamber Sc being in a midstream of compression in the compression mechanism 20 via a not-illustrated passage formed in the fixed scroll 30. The compression chamber Sc, with which the injection pipe 18*c* communicates and which is in the midstream of compression, is supplied with an intermediate-pressure refrigerant in the refrigeration cycle from the refrigerant circuit 5 of the refrigeration cycle apparatus 1 via the injection pipe 18*c*.

(2-2) Compression Mechanism

The compression mechanism 20 mainly includes the fixed scroll 30 and a movable scroll 40. The fixed scroll 30 and the movable scroll 40 are combined to form the compression chamber Sc. The compression mechanism 20 compresses a refrigerant in the compression chamber Sc and discharges the compressed refrigerant.

(2-2-1) Fixed Scroll

The fixed scroll 30 is mounted on and fastened to the housing 50 with a not-illustrated fixing means (for example, a bolt).

As illustrated in FIG. 1, the fixed scroll 30 mainly includes a fixed-side end plate 32, a fixed-side wrap 34, and a peripheral edge portion 36.

The fixed-side end plate 32 is a circular plate-shaped member. The fixed-side wrap 34 is a wall-shaped member protruding toward the movable scroll 40 from a front surface 32*a* (lower surface) of the fixed-side end plate 32. When the fixed scroll 30 is seen from below, the fixed-side wrap 34 is formed in a spiral shape (an involute shape) from a region near a center toward an outer periphery of the fixed-side end plate 32. The peripheral edge portion 36 is a thick cylindrical member protruding from the front surface 32*a* of the fixed-side end plate 32 toward the movable scroll 40. The peripheral edge portion 36 is disposed to surround the periphery of the fixed-side wrap 34. The peripheral edge portion 36 is provided with the suction port 36*a*. A downstream end of the suction pipe 18*a* is connected to the suction port 36*a*.

The fixed-side wrap 34 of the fixed scroll 30 and a movable-side wrap 44 of the movable scroll 40 are combined to form the compression chamber Sc. Specifically, the fixed scroll 30 and the movable scroll 40 are combined in a state where the front surface 32*a* of the fixed-side end plate 32 and a front surface 42*a* (upper surface) of a movable-side end plate 42 are opposed to each other. As a result, the compression chamber Sc surrounded by the fixed-side end plate 32, the fixed-side wrap 34, the movable-side wrap 44, and the below-mentioned movable-side end plate 42 of the movable scroll 40 is formed (refer to FIG. 1). When the movable scroll 40 turns with respect to the fixed scroll 30, a low-pressure refrigerant flowing from the suction pipe 18*a* via the suction port 36*a* into the peripheral edge-side compression chamber Sc is compressed. The pressure of the refrigerant increases as the refrigerant approaches the center-side compression chamber Sc.

The fixed-side end plate 32 has at its approximately center part a discharge port 33 through which the refrigerant compressed by the compression mechanism 20 is discharged. The discharge port 33 is formed to penetrate the fixed-side end plate 32 in a thickness direction (up-down direction) (refer to FIG. 1). The discharge port 33 communicates with the center-side (innermost-side) compression chamber Sc in the compression mechanism 20. A discharge valve 22 that opens and closes the discharge port 33 is attached to an upper side of the fixed-side end plate 32. When a pressure in the innermost-side compression chamber Sc, with which the discharge port 33 communicates, is equal to or higher than a pressure in a discharge space Sa above the discharge valve 22 by a predetermined value, the discharge valve 22 is opened to cause the refrigerant in the innermost-side compression chamber Sc to pass through the discharge port 33 and flow into the discharge space Sa above the fixed-side end plate 32. The discharge space Sa communicates with a not-illustrated refrigerant passage formed over the fixed scroll 30 and the housing 50. The refrigerant passage is a passage that causes the discharge space Sa and the first space S1 below the housing 50 to communicate with each other. The refrigerant compressed by the compression mechanism 20 and then flowing into the discharge space Sa passes through the refrigerant passage and flows into the first space S1.

(2-2-2) Movable Scroll

As illustrated in FIG. 1, the movable scroll 40 mainly includes the movable-side end plate 42, the movable-side wrap 44, and a boss portion 46.

The movable-side end plate 42 is a circular plate-shaped member. The movable-side wrap 44 is a wall-shaped member protruding toward the fixed scroll 30 from the front surface 42*a* (upper surface) of the movable-side end plate 42. When the movable scroll 40 is seen from above, the movable-side wrap 44 is formed in a spiral shape (an involute shape) from a region near a center toward an outer periphery of the movable-side end plate 42. The boss portion 46 is a cylindrical member protruding from a back surface 42*b* (lower surface) of the movable-side end plate 42 toward the motor 70.

While the scroll compressor 100 is operating, the movable scroll 40 is pressed against the fixed scroll 30 by a pressure of a crank chamber 52 and a back pressure space 54, which will be described below, disposed on a side of a back surface 42*b* of the movable-side end plate 42. Since the movable scroll 40 is pressed against the fixed scroll 30, leakage of the refrigerant from a gap between a tip of the fixed-side wrap 34 and the movable-side end plate 42 and a gap between a tip of the movable-side wrap 44 and the fixed-side end plate 32 is reduced.

The boss portion 46 is disposed in the below-mentioned crank chamber 52 formed by the housing 50. The boss portion 46 is formed in a cylindrical shape. The boss portion 46 extends to protrude downward from the back surface 42*b* of the movable-side end plate 42. An upper portion of the cylindrical boss portion 46 is closed by the movable-side end plate 42. A bearing metal 47 is disposed in a hollow part of the boss portion 46. A below-mentioned eccentric portion 84 of the drive shaft 80 is inserted into the hollow part of the boss portion 46 (refer to FIG. 1). The drive shaft 80 is connected to a rotor 74 of the motor 70 as described below. Therefore, when the motor 70 is operated and the rotor 74 rotates, the movable scroll 40 turns.

The movable scroll 40, which is turned by the motor 70, does not rotate by itself but moves in orbit with respect to the fixed scroll 30 by means of an Oldham coupling 24 (refer to FIG. 1) disposed on the side of the back surface 42*b* of the movable scroll 40.

When the movable scroll 40 moves in orbit with respect to the fixed scroll 30, the gas refrigerant in the compression chamber Sc of the compression mechanism 20 is compressed. More specifically, when the movable scroll 40 moves in orbit, the gas refrigerant is sucked from the suction pipe 18*a* via the suction port 36*a* into the peripheral edge-side compression chamber Sc, and thereafter, the compression chamber Sc moves toward a center of the compression mechanism 20 (center of the fixed-side end plate 32). As the compression chamber Sc moves toward the center of the compression mechanism 20, a volume of the compression chamber Sc decreases and a pressure in the compression chamber Sc increases. As a result, the center-side compression chamber Sc has a higher pressure than the peripheral edge-side compression chamber Sc. The gas refrigerant compressed by the compression mechanism 20 to have a high pressure is discharged from the center-side compression chamber Sc through the discharge port 33 formed in the fixed-side end plate 32 into the discharge space Sa. The refrigerant discharged into the discharge space Sa passes through the not-illustrated refrigerant passage formed through the fixed scroll 30 and the housing 50, and flows into the first space S1 below the housing 50.

(2-3) Housing

The housing 50 will be described with reference to FIGS. 2 to 4 as well.

Figure 2:
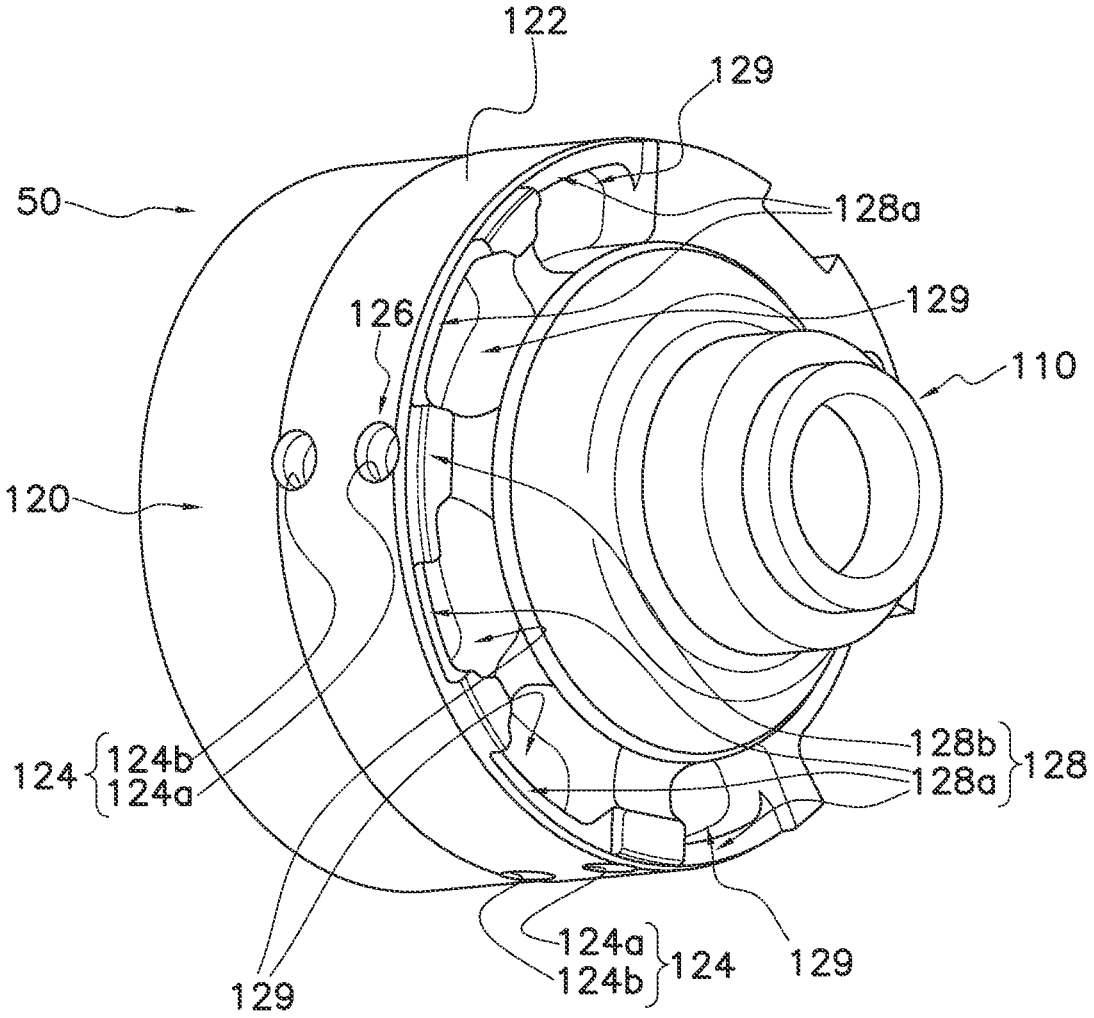
FIG. 2 is a perspective view of a housing of the scroll compressor in FIG. 1 as viewed from below.

FIG. 2 is a perspective view of the housing 50 as viewed from below. FIG. 3 is a schematic side view of the housing 50. FIG. 4 is a schematic view of a fixed state between the casing 10 and the welding pin 60.

The housing 50 is a cast product. As illustrated in FIG. 1, the housing 50 mainly includes a main body portion 120 and an upper bearing housing 110. The main body portion 120 is a cylindrical part. The upper bearing housing 110 also has a cylindrical shape. The upper bearing housing 110 is disposed closer to the motor 70 than the main body portion 120 in an axial direction of the drive shaft 80. The upper bearing housing 110 is disposed close to the compression mechanism 20 than the motor 70.

The housing 50 is an example of a support. The housing 50 supports a bearing metal 112 provided in the upper bearing housing 110.

The fixed scroll 30 is fixed to the main body portion 120 of the housing 50. Specifically, the fixed scroll 30 is mounted on the housing 50 in a state where a lower surface of the peripheral edge portion 36 of the fixed scroll 30 is opposed to an upper surface of the housing 50, and is fixed to the housing 50 by a not-illustrated fixing member (for example, a bolt). The housing 50 supports the fixed scroll 30 fixed to the main body portion 120.

The housing 50 also supports the movable scroll 40 disposed between the fixed scroll 30 and the main body portion 120 of the housing 50. The housing 50 supports the movable scroll 40 from below via the Oldham coupling 24 disposed on an upper side of the housing 50.

The main body portion 120 of the housing 50 is a cylindrical member. The main body portion 120 of the housing 50 is fixed to an inner peripheral surface of the cylindrical member 12 of the casing 10.

Specifically, the housing 50 is press-fitted into the cylindrical member 12 of the casing 10, and an outer peripheral surface of the main body portion 120 is in close contact with an inner peripheral surface of the cylindrical member 12, partially in the axial direction of the drive shaft 80, in entire circumference.

The housing 50 is further fixed to the cylindrical member 12 of the casing 10 by welding. The fixing of the housing 50 to the cylindrical member 12 by welding will specifically be described.

Figure 3:
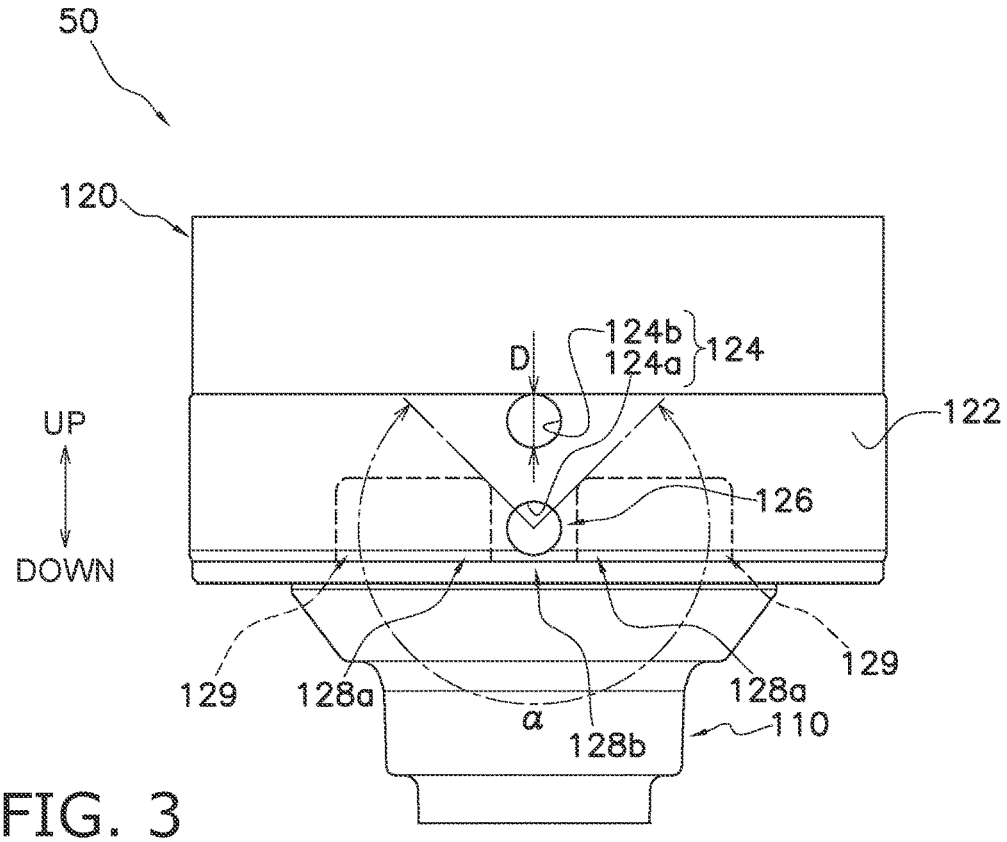
FIG. 3 is a schematic side view of the housing of the scroll compressor in FIG. 1.

As illustrated in FIGS. 2 and 3, holes 124 into which the welding pins 60 are press-fitted are formed on an outer surface 122 (outside surface) of the main body portion 120 of the housing 50. Each of the holes 124 have a substantially equal shape to a cross section of the welding pin 60 obtained by cutting the welding pin 60 in a direction orthogonal to a press-fitting direction of the welding pin 60 (a direction in which the welding pin 60 is press-fitted into the hole 124). In the present embodiment, each of the holes 124 has a circular shape. The holes 124 do not penetrate the main body portion 120 in a radial direction of the cylindrical member 12 of the casing 10. In other words, the holes 124 are concave portions that do not penetrate the housing 50 in the radial direction of the cylindrical member 12.

Although dimensions are not limited, in the present embodiment, a diameter D of the hole 124 is 12 mm, and a depth A of a portion having the diameter D is 9 mm. The depth A of the hole 124 means a depth of the hole 124 from the outer surface 122 to a bottom portion 125 of the hole 124 of the main body portion 120 of the housing 50. The bottom portion 125 of the hole 124 means an inner wall portion of the portion having the diameter D of the hole 124 in the radial direction of the cylindrical member 12. Although a number is not limited, the holes 124 are formed at a total of eight positions on the outer surface 122 of the housing 50. Although a position is not limited, on the outer surface 122 of the housing 50, the holes 124 are formed at four locations at intervals of 90° in a circumferential direction. At each of four locations, the holes 124 are formed at two positions in the axial direction (here, an up-down direction) of the drive shaft 80.

In the present embodiment, the shapes and dimensions of the holes 124 are all equal. However, the present invention is not limited thereto, and the shape and dimension of the hole 124 may vary depending on the position.

For convenience of description, among the holes 124 formed at two positions in the axial direction of the drive shaft 80, a hole disposed on an upper side is labeled with reference sign 124*b*, and a hole disposed on a lower side is labeled with reference sign 124*a*. For convenience of description, in some cases, the hole 124 disposed on the lower side is referred to as a first hole 124*a*, and the hole 124 disposed on the upper side is referred to as a second hole 124*b*.

A low rigidity region 128 is provided at least a part of a periphery of an adjacent portion 126 adjacent to the hole 124 of the housing 50. The low rigidity region 128 has lower rigidity than the adjacent portion 126 and including a thin portion 128*a* to be described below. The low rigidity region 128 will be described below.

Figure 4:
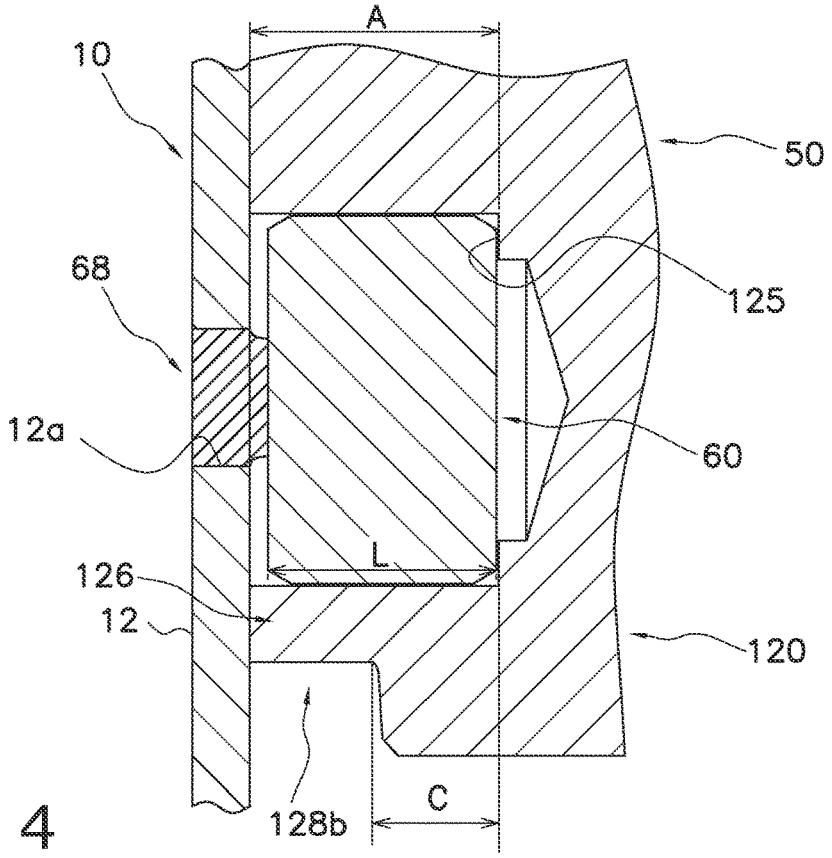
FIG. 4 is a schematic view of a fixed state between a casing and a welding pin of the scroll compressor in FIG. 1.

A through hole 12*a* is formed at positions of the cylindrical member 12 of the casing 10 that correspond to the welding pin 60 of the housing 50 press-fitted into the cylindrical member 12 (a position corresponding to the hole 124 of the housing 50) as illustrated in FIG. 4. At a position of the through hole 12*a*, the welding pin 60 press-fitted into the hole 124 and the cylindrical member 12 of the casing 10 are welded and fixed. A portion indicated by reference sign 68 in FIG. 4 indicates a welded portion between the welding pin 60 and the cylindrical member 12. As a result of the welding pin 60 press-fitted into the hole 124 of the main body portion 120 of the housing 50 being welded and fixed to the cylindrical member 12, the housing 50 is fixed to the cylindrical member 12 of the casing 10 by welding as well.

Note that the housing 50 and the casing 10 are not directly welded, but the welding pin 60 and the casing 10 are welded. This is because the housing 50 is a cast product and it is generally difficult to weld the cast product.

The housing 50 will further be described.

As illustrated in FIG. 1, the main body portion 120 of the housing 50 includes a first concave portion 56 disposed to be recessed at a center and a second concave portion 58 disposed to surround the first concave portion 56. The first concave portion 56 constitutes a side surface of the crank chamber 52 in which the boss portion 46 of the movable scroll 40 is disposed. The second concave portion 58 forms the annular back pressure space 54 on the side of the back surface 42*b* of the movable-side end plate 42.

During operation of the scroll compressor 100, the refrigerator oil flows into the crank chamber 52 from the oil reservoir space 16. Therefore, during steady operation of the scroll compressor 100 (in a state where operation of the scroll compressor 100 is stable), a pressure of the crank chamber 52 becomes a high pressure in the refrigeration cycle of the refrigeration cycle apparatus 1. As a result, during the steady operation of the scroll compressor 100, a center portion of the back surface 42*b* of the movable-side end plate 42 facing the crank chamber 52 is pushed toward the fixed scroll 30 at the high pressure.

When the movable scroll 40 turns during operation of the scroll compressor 100, the back pressure space 54 communicates with the compression chamber Sc in the midstream of compression via a not-illustrated hole formed in the movable-side end plate 42 for a predetermined period during one turn of the movable scroll 40. Therefore, during the steady operation of the scroll compressor 100, a pressure in the back pressure space 54 becomes the intermediate pressure in the refrigeration cycle of the refrigeration cycle apparatus 1 (a pressure between the high and low pressure in the refrigeration cycle of the refrigeration cycle apparatus 1). As a result, during the steady operation of the scroll compressor 100, a peripheral edge portion of the back surface 42*b* of the movable-side end plate 42 facing the back pressure space 54 is pushed toward the fixed scroll 30 at the intermediate pressure.

As a result of the above configuration, during the steady operation of the scroll compressor 100, the movable scroll 40 is pressed against the fixed scroll 30 by the high pressure in the crank chamber 52 and the intermediate pressure in the back pressure space 54. The crank chamber 52 and the back pressure space 54 are separated from each other by an annular wall portion 57 disposed at a boundary between the first concave portion 56 and the second concave portion 58 (refer to FIG. 1). A not-illustrated seal ring is disposed on an upper end of the wall portion 57 opposed to the back surface 42*b* of the movable-side end plate 42 so as to seal a space between the crank chamber 52 and the back pressure space 54.

The upper bearing housing 110 has a cylindrical shape. The bearing metal 112 that rotatably supports the drive shaft 80 is provided inside the cylindrical upper bearing housing 110. The bearing metal 112 is an example of a bearing. During operation of the scroll compressor 100, a moment that causes the drive shaft 80 to fall may act on the drive shaft 80. An elastic groove 115 is formed in a connection portion between the upper bearing housing 110 and the main body portion 120 so as to allow inclination of the upper bearing housing 110 when the moment acts on the drive shaft 80.

(2-4) Welding Pin

The welding pin 60 is a member press-fitted into the hole 124 of the main body portion 120 of the housing 50 and a hole 96 of the lower bearing housing 90 described below.

Figure 5:
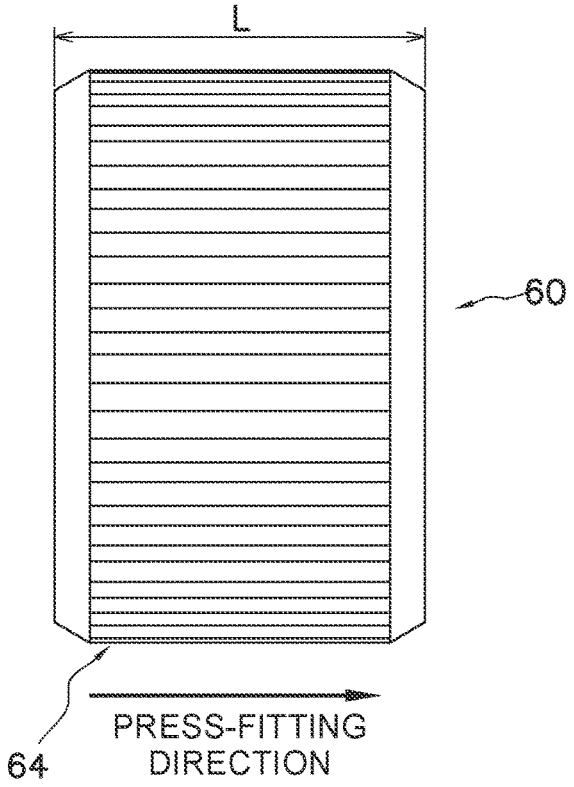
FIG. 5 is a view of the welding pin before being press-fitted used in the scroll compressor in FIG. 1, as viewed along a direction orthogonal to a press-fitting direction of the welding pin.
Figure 6:
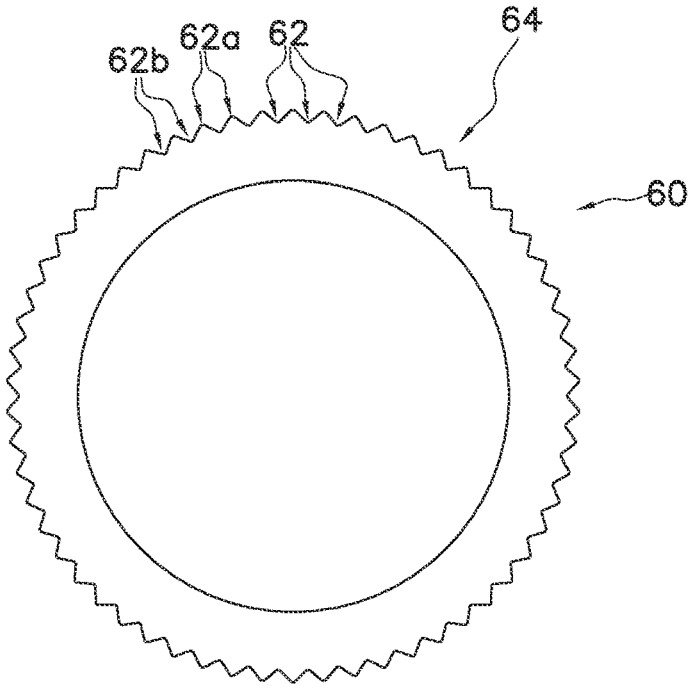
FIG. 6 is a view of the welding pin before being press-fitted used in the scroll compressor in FIG. 1, as viewed along the press-fitting direction of the welding pin.

The welding pin 60 will be described with reference to FIGS. 5 to 6 as well. FIG. 5 is a view of the welding pin 60 before being press-fitted into the hole 124 of the main body portion 120 of the housing 50 or the hole 96 of the lower bearing housing 90 as viewed along the direction orthogonal to the press-fitting direction of the welding pin 60. FIG. 6 is a view of the welding pin 60 before being press-fitted into the hole 124 of the main body portion 120 of the housing 50 or the hole 96 of the lower bearing housing 90 as viewed along the press-fitting direction of the welding pin 60. The press-fitting direction of the welding pin 60 means a direction in which the welding pin 60 is press-fitted into the hole 124 of the main body portion 120 of the housing 50 or the hole 96 of the lower bearing housing 90.

Here, the welding pin 60 will be described by taking the welding pin 60 press-fitted into the hole 124 of the main body portion 120 of the housing 50 as an example.

As is apparent from FIGS. 5 and 6, the welding pin 60 is a substantially cylindrical member. As illustrated in FIG. 6, the welding pin 60 has a substantially circular shape when viewed along the press-fitting direction of the welding pin 60.

A concave-convex surface 64 having a concave-convex shape is provided on an outer periphery of the welding pin 60. Specifically, a plurality of grooves 62 are formed along the press-fitting direction of the welding pin 60 on the outer periphery of the welding pin 60. In other words, a flat knurling is formed on at least a part of an outer peripheral surface of the welding pin 60 by knurling. As a result of such a configuration, when the welding pin 60 is viewed along the press-fitting direction of the welding pin 60, a convex portion 62*a* and a concave portion 62*b* (portion of the groove 62) are disposed alternately along a circumferential direction of the welding pin 60 on the outer peripheral surface of the welding pin 60 (refer to FIG. 6).

A dimension of the welding pin 60 in a radial direction (direction orthogonal to the press-fitting direction of the welding pin 60), a length L of the welding pin 60 (length in the press-fitting direction of the welding pin 60), and a shape of the welding pin 60 are appropriately designed so that the welding pin 60 can be press-fitted into the hole 124. Although not limited, the length L of the welding pin 60 is 8 mm.

The welding pin 60 is fixed to the main body portion 120 of the housing 50 by being press-fitted into the hole 124 of the main body portion 120 of the housing 50. When press-fitted into the hole 124, the convex portion 62*a* of the welding pin 60 is partially plastically deformed. Further, the welding pin 60 is expanded due to heat input at a time of welding with the cylindrical member 12 of the casing 10, and the convex portion 62*a* of the welding pin 60 is pressed against an inner surface of the hole 124, so that the convex portion 62*a* of the welding pin 60 is further plastically deformed at the time of welding. Since the welding pin 60 thermally expanded during welding contracts after welding, a holding force of the welding pin 60 with respect to the main body portion 120 of the housing 50 may be lower than that before welding because an elasticity of the convex portion 62*a* is lowered due to plastic deformation. Here, the holding force of the welding pin 60 with respect to the main body portion 120 of the housing 50 means a magnitude of a maximum force with which the welding pin 60 does not move in a direction opposite to the press-fitting direction when a force in the direction opposite to the press-fitting direction of the welding pin 60 is applied to the welding pin 60 press-fitted into the main body portion 120.

When the drive shaft 80 rotates, the moment acts on the drive shaft 80, and a moment also acts on the upper bearing housing 110 provided with the bearing metal 112 pivotally supporting the drive shaft 80. As a result, during operation of the scroll compressor 100, a force may repeatedly act on the main body portion 120 of the housing 50 at least partially in a direction of being away from the casing 10. In a case where the holding force of the welding pin 60 is too small, there is a possibility that the welding pin 60 is displaced in the direction opposite to the press-fitting direction due to an influence of the moment, and a problem such as lowering of a fixing force of the housing 50 with respect to the cylindrical member 12 of the casing 10 may occur. To suppress excessive lowering of the holding force of the welding pin 60, at least a part of the periphery of the adjacent portion 126 adjacent to the hole 124 of the main body portion 120 of the housing 50 is provided with the low rigidity region 128. The low rigidity region 128 has lower rigidity than the adjacent portion 126 and includes the thin portion 128*a* to be described below.

As a measure for raising the holding force of the welding pin 60, it is also conceivable to increase the length L of the welding pin 60 in the press-fitting direction. However, it may be difficult to increase the length L of the welding pin 60 from viewpoints of avoiding an increase in size of the scroll compressor 100 and avoiding contact between welding pin 60 and other parts (for example, a fixing member that fixes the housing 50 and the fixed scroll 30 to each other).

(2-5) Motor

The motor 70 is an example of an actuator. The motor 70 includes an annular stator 72 fixed to an inner wall surface of the cylindrical member 12 of the casing 10, and the rotor 74 disposed on an inner side of the stator 72 (refer to FIG. 1).

The rotor 74 is rotatably housed on the inner side of the stator 72 with a small gap (not illustrated) from the stator 72. The rotor 74 is coupled to the movable scroll 40 of the compression mechanism 20 via the drive shaft 80. Specifically, the rotor 74 is coupled to the boss portion 46 of the movable scroll 40 via the drive shaft 80 (refer to FIG. 1). The motor 70 turns the movable scroll 40 by rotating the rotor 74.

(2-6) Drive Shaft

The drive shaft 80 couples the rotor 74 of the motor 70 to the movable scroll 40 of the compression mechanism 20. The drive shaft 80 extends in the up-down direction. The drive shaft 80 transmits a driving force of the motor 70 to the movable scroll 40 of the compression mechanism 20.

The drive shaft 80 mainly includes a main shaft 82 and the eccentric portion 84 (refer to FIG. 1).

The main shaft 82 extends in the up-down direction from the oil reservoir space 16 to the crank chamber 52. The main shaft 82 is rotatably supported by the bearing metal 112 of the upper bearing housing 110 and a bearing metal 91 disposed in the lower bearing housing 90. The main shaft 82 is inserted into and coupled to the rotor 74 of the motor 70 at a position between the upper bearing housing 110 of the housing 50 and the lower bearing housing 90. A center axis of the main shaft 82 coincides with the center axis O of the cylindrical member 12 of the casing 10.

The eccentric portion 84 is disposed at an upper end of the main shaft 82. A center axis of the eccentric portion 84 is eccentric to the center axis of the main shaft 82. The eccentric portion 84 is inserted into the boss portion 46 of the movable scroll 40 and is rotatably supported by the bearing metal 47 disposed inside the boss portion 46.

The drive shaft 80 has an oil passage 86. The oil passage 86 includes a main passage 86*a* and a branch passage (not illustrated). The main passage 86*a* extends from a lower end to an upper end of the drive shaft 80 in the axial direction of the drive shaft 80. The branch passage branches off the main passage and extends in a direction intersecting with the axial direction of the drive shaft 80. The refrigerator oil in the oil reservoir space 16 is pumped up by a pump (not illustrated) disposed at the lower end of the drive shaft 80, and is then supplied to, for example, sliding portions between the drive shaft 80 and the bearing metals 47, 112, and 91, and a sliding portion of the compression mechanism 20, via the oil passage 86.

(2-7) Lower Bearing Housing

The lower bearing housing 90 (refer to FIG. 1) is disposed below the motor 70.

The lower bearing housing 90 mainly includes a main body portion 92 and a plurality of arms 94 extending from the main body portion 92 in the radial direction of the cylindrical member 12 of the casing 10. Although a number is not limited, the lower bearing housing 90 has three arms 94. The lower bearing housing 90 is a cast product.

The main body portion 92 is formed in a cylindrical shape. The bearing metal 91 that rotatably supports the drive shaft 80 is provided inside the cylindrical main body portion 92.

Although a structure is not limited, on the main body portion 92, the three arms 94 are provided at substantially equal intervals (at 120° intervals) in a circumferential direction of the cylindrical member 12 of the casing 10. On an outer peripheral surface of an end portion of each of the arms 94 (a surface, of the end portion of the arm 94 extending from the main body portion 92, opposed to the cylindrical member 12 of the casing 10), the hole 96 into which the welding pin 60 is press-fitted is formed.

A shape of the hole 96 formed in the arm 94 is equal to the hole 124 formed in the main body portion 120 of the housing 50. However, the shape of the hole 96 formed in the arm 94 is not limited thereto, and for example, the shape of the hole 96 may be different from the hole 124 formed in the main body portion 120 of the housing 50. Here, a detailed description of the hole 96 is omitted in order to avoid duplication of description.

Holes (not illustrated) similar to the through hole 12*a* illustrated in FIG. 4 are formed in the cylindrical member 12 of the casing 10 at a position corresponding to the welding pin 60 of the lower bearing housing 90 (a position corresponding to the hole 96 of the lower bearing housing 90). At the position of the through hole, the welding pin 60 and the cylindrical member 12 of the casing 10 are fixed by welding. As a result of the welding pin 60 press-fitted into the hole 96 of the lower bearing housing 90 being welded and fixed to the cylindrical member 12, the lower bearing housing 90 is fixed to the cylindrical member 12 of the casing 10 by welding.

(3) Low Rigidity Region of Housing

To suppress excessive lowering of the holding force of the welding pin 60, at least a part of the periphery of the adjacent portion 126 adjacent to the hole 124 of the main body portion 120 of the housing 50 is provided with the low rigidity region 128. The low rigidity region 128 has lower rigidity than the adjacent portion 126 and includes the thin portion 128*a* to be described below.

The reason why the excessive lowering of the holding force of the welding pin 60 is suppressed by providing the low rigidity region 128 is generally as follows.

When the welding pin 60 press-fitted into the hole 124 is welded, the welding pin 60 is thermally expanded by heat input. If the low rigidity region 128 including the thin portion 128*a* does not exist, a deformation around the hole 124 is relatively strongly restricted. Therefore, a large force acts on the thermally expanded welding pin 60 from the main body portion 120 of the housing 50, and a plastic deformation of the convex portion 62*a* of the welding pin 60 tends to progress.

On the other hand, in a case where the low rigidity region 128 including the thin portion 128*a* having lower rigidity than the adjacent portion 126 exists as shown in the present embodiment, when the welding pin 60 is thermally expanded, the adjacent portion 126 adjacent to the hole 124 is relatively easily deformed in accordance with the thermal expansion of the welding pin 60. Therefore, a force exerted on the welding pin 60 by the adjacent portion 126 becomes relatively small, and the plastic deformation of the convex portion 62*a* of the welding pin 60 tends to be suppressed. In short, the low rigidity region 128 including the thin portion 128*a* is a deformation allowing region that allows deformation of the housing 50 when the welding pin 60 is thermally expanded.

In the present embodiment, the low rigidity regions 128 are disposed around the first holes 124*a* out of the holes 124 of the main body portion 120 of the housing 50 provided at two positions in the axial direction of the drive shaft 80 at each of four locations in the circumferential direction of the cylindrical member 12 of the casing 10. The first hole 124*a* is a hole disposed closest to the bearing metal 112 in the axial direction of the drive shaft 80 out of the two holes 124 provided in the axial direction of the drive shaft 80.

Figure 7:
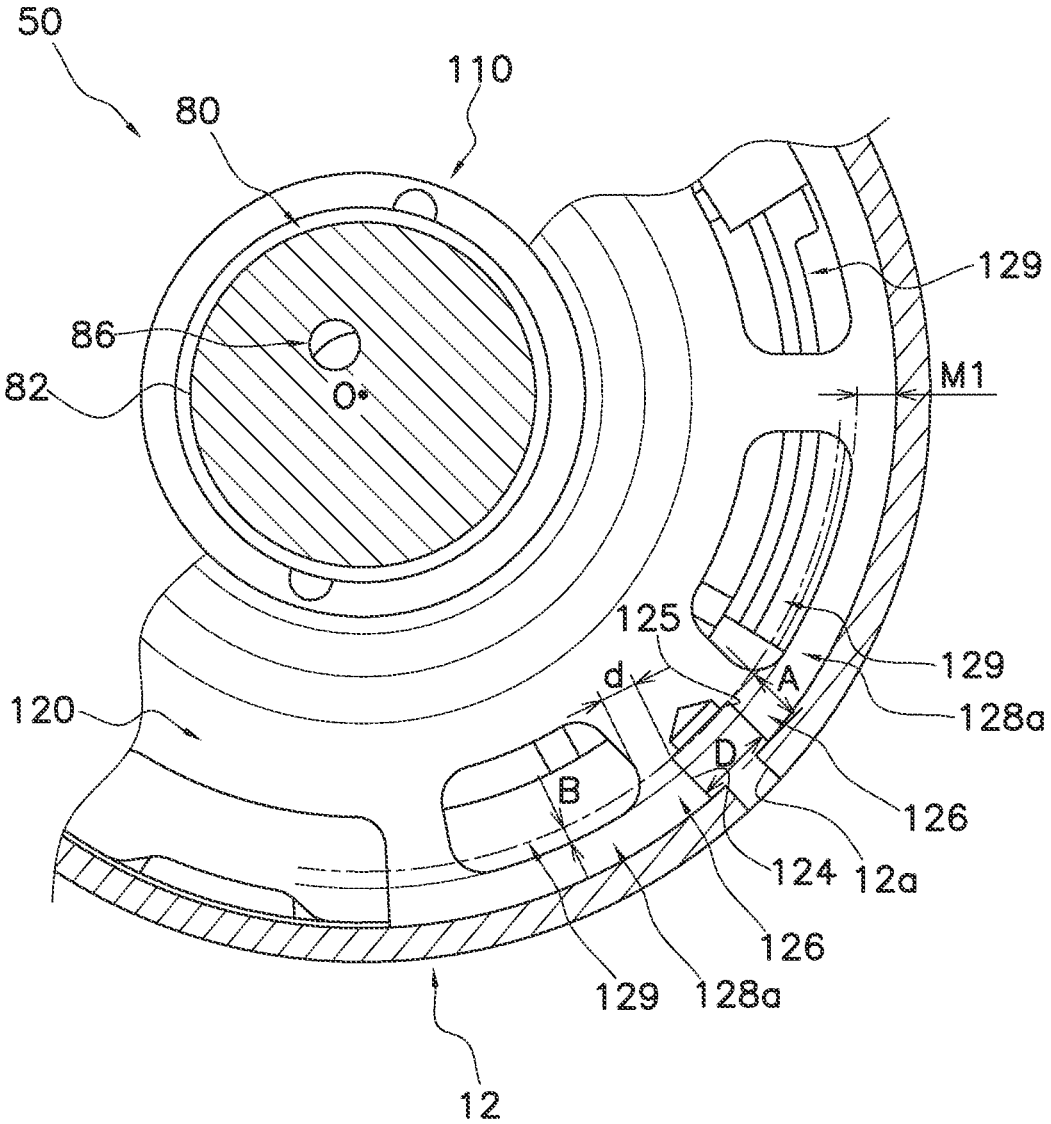
FIG. 7 is a schematic partial cross-sectional view taken along line VII-VII in FIG. 1, in which the welding pin is not drawn.
Figure 8:
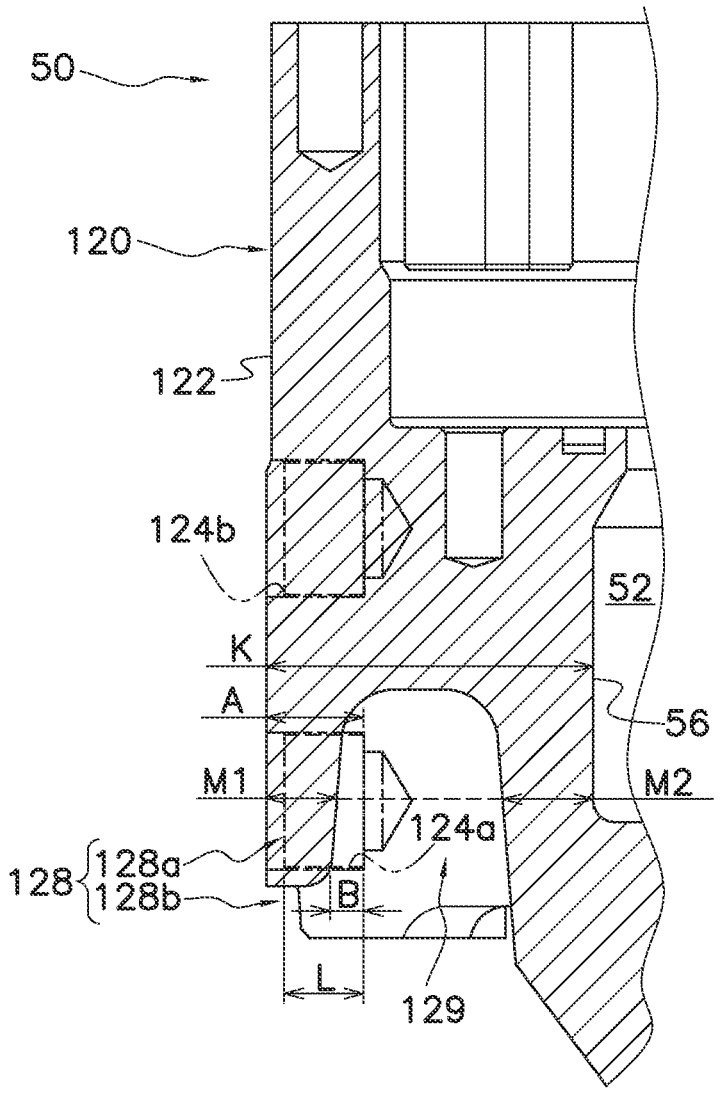
FIG. 8 is a schematic partial longitudinal cross-sectional view for explaining an overlapping state between a region where a downgage exists and a region where the welding pin exists in the scroll compressor in FIG. 1.

The low rigidity region 128 will be described in detail with reference to FIGS. 7 and 8 as well as FIGS. 1 to 4. FIG. 7 is a schematic partial cross-sectional view taken along line VII-VII in FIG. 1. In FIG. 7, the welding pin 60 is not drawn. FIG. 8 is a schematic partial longitudinal cross-sectional view for explaining an overlapping state between a region where a downgage 129 to be described below exists and a region where the welding pin 60 exists.

First, the adjacent portion 126 will be described. The adjacent portion 126 exists at a position adjacent to the first hole 124*a* of the main body portion 120 of the housing 50. The adjacent portion 126 is disposed so as to surround an entire circumference of the first hole 124*a* when the first hole 124*a* formed in the outer surface 122 of the main body portion 120 is viewed from a position just facing the first hole 124*a*. In the adjacent portion 126, in the radial direction of the cylindrical member 12 of the casing 10, a member (cast product constituting the housing 50) exists from the outer surface 122 of the main body portion 120 of the housing 50 to at least a position of the depth A of the first hole 124*a*. In other words, the adjacent portion 126 has a thickness of at least "A" in the radial direction of the cylindrical member 12 of the casing 10. In particular, in the present embodiment, in the adjacent portion 126, the member exists in a range from the outer surface 122 of the main body portion 120 to the crank chamber 52 in the radial direction of the cylindrical member 12 of the casing 10. In the adjacent portion 126, a member having a thickness of K (refer to FIG. 8) at minimum exists in the radial direction of the cylindrical member 12 of the casing 10.

The low rigidity region 128 having lower rigidity than the adjacent portion 126 is provided in at least a part of the periphery of the adjacent portion 126. The low rigidity region 128 includes the thin portion 128*a* having a smaller thickness in the radial direction of the cylindrical member 12 of the casing 10 than the adjacent portion 126. In addition, the low rigidity region 128 includes a void portion 128*b* in which the main body portion 120 (member constituting the main body portion 120) does not exist.

The thin portion 128*a* is disposed, so as to interpose the first hole 124*a*, on both sides of the first hole 124*a* in the circumferential direction of the cylindrical member 12 of the casing 10 (refer to FIGS. 2 and 3). The thin portion 128*a* is an example of a first portion. In the thin portion 128*a*, the downgage 129 is formed closer to the center axis O (refer to FIG. 3) of the cylindrical member 12 of the casing 10 than the outer surface 122 of the main body portion 120 of the housing 50. In other words, in the thin portion 128*a*, when the main body portion 120 of the housing 50 is viewed from a side provided with the motor 70, a concave portion 129 is formed closer to the center axis O of the cylindrical member 12 of the casing 10 than the outer surface 122 of the main body portion 120 of the housing 50 (refer to FIG. 7). As illustrated in FIGS. 3 and 7, the downgage 129 is disposed on both sides of each of the four first holes 124*a* in the circumferential direction of the cylindrical member 12 of the casing 10 so as to interpose the first hole 124*a*. The downgage 129, that is, the concave portion 129, is formed from a bottom portion of the main body portion 120 of the housing 50 to an intermediate portion between the first hole

124*a* and the second hole 124*b* in the axial direction of the drive shaft 80 (refer to FIGS. 3 and 8). The downgage 129 may be provided during casting or by machining the cast product.

As a result of forming the downgage 129, a thickness M of the thin portion 128*a* of the casing 10 in the radial direction of the cylindrical member 12 is smaller than a minimum thickness K of the adjacent portion 126. The thickness M of the thin portion 128*a* in the radial direction of the cylindrical member 12 means a total thickness of a portion where a member exists, disposed between the outer surface 122 of the main body portion 120 and the crank chamber 52 in the circumferential direction of the cylindrical member 12. For example, in FIG. 8, a total of a thickness M1 and a thickness M2 is the thickness M of the thin portion 128*a* in the radial direction of the cylindrical member 12. For example, the thickness M of the thin portion 128*a* does not need to be uniform as illustrated in FIG. 8, or the thin portion 128*a* may be formed so that the thickness M is uniform.

In the thin portion 128*a* of the present embodiment, the thickness M1 from the outer surface 122 of the main body portion 120 to the downgage 129 is smaller than the depth A of the first hole 124*a* in the radial direction of the cylindrical member 12 of the casing 10. In short, in the adjacent portion 126, the member exists from the outer surface 122 of the main body portion 120 to a position of a thickness A (=the depth A of the first hole 124*a*) in the radial direction of the cylindrical member 12 of the casing 10, whereas in the thin portion 128*a*, the thickness M1 from the outer surface 122 of the main body portion 120 to the downgage 129 is smaller than the thickness A in the radial direction of the cylindrical member 12 of the casing 10.

In the radial direction of the cylindrical member 12 of the casing 10, the region where the downgage 129 exists and the region where the welding pin 60 press-fitted into the first hole 124*a* exists preferably overlap with each other in a range of 10% or more of a length of the welding pin 60 press-fitted into the first hole 124*a* in the radial direction of the cylindrical member 12 of the casing 10 (in other words, the length L of the welding pin 60 in the press-fitting direction). It is assumed that the welding pin 60 is press-fitted to a position where the welding pin abuts against the bottom portion 125 of the first hole 124*a*. In other words, in the radial direction of the cylindrical member 12 of the casing 10, a value B obtained by subtracting the thickness M1 from the outer surface 122 of the main body portion 120 to the downgage 129 in the thin portion 128*a* from the depth A of the first hole 124*a* is preferably 10% or more of the length L of the welding pin 60 in the press-fitting direction. More specifically, for example, in the radial direction of the cylindrical member 12 of the casing 10, a value obtained by subtracting an average of the thicknesses from the outer surface 122 of the main body portion 120 to the downgage 129 in the thin portion 128*a* from the depth A of the first hole 124*a* is preferably 10% or more of the length L of the welding pin 60 in the press-fitting direction.

The void portion 128*b* is disposed closer to the motor 70 than the first hole 124*a* in the axial direction of the drive shaft 80. In other words, the void portion 128*b* is disposed below the first hole 124*a* in the axial direction of the drive shaft 80. In short, as illustrated in FIG. 4, the main body portion 120 (member constituting the main body portion 120) does not exist in at least a partial region below the adjacent portion 126 below the first hole 124*a*. Since the void portion 128*b* exists, a thickness C of the main body portion 120 outside a position of the bottom portion 125 of the first hole 124*a* in the radial direction of the cylindrical member 12 of the casing 10 at a height position where the void portion 128*b* exists below the adjacent portion 126 below the first hole 124*a* is smaller than the depth A of the first hole 124*a* (refer to FIG. 4). In FIG. 4, a mode in which the main body portion 120 exists in a partial region immediately below the adjacent portion 126 adjacent below the first hole 124*a* is illustrated, but the present invention is not limited thereto. The main body portion 120 does not need to exist immediately below the adjacent portion 126 adjacent below the first hole 124*a*. In other words, for example, only the void portion 128*b* may be disposed immediately below the adjacent portion 126 adjacent below the first hole 124*a*.

In the present embodiment, as a result of providing the thin portion 128*a* and the void portion 128*b*, as illustrated in FIG. 3, the low rigidity region 128 is provided in a region (angular region indicated by "a" in FIG. 3) at 180° or more around a center of the first hole 124*a* when the first hole 124*a* is viewed from a position just facing the first hole 124*a* (when the first hole 124*a* is viewed from its front in a horizontal direction orthogonal to the axial direction of the drive shaft 80).

A ratio of a minimum distance d from the first hole 124*a* to the low rigidity region 128 to the diameter D of the first hole 124*a* is preferably 0.25 or more and 0.85 or less. In the present embodiment, since the diameter D of the first hole 124*a* is 12 mm, the minimum distance d from the first hole 124*a* to the low rigidity region 128 is preferably 3.0 mm or more and 10.2 mm or less. In other words, the downgage 129 is preferably disposed to be away from the first hole 124*a* by 3.0 mm or more and not to be away from the first hole 124*a* by more than 10.2 mm. Also, the void portion 128*b* is preferably disposed to be away from the first hole 124*a* by 3.0 mm or more and not to be away from the first hole 124*a* by more than 10.2 mm.

By providing the first hole 124*a* away from the low rigidity region 128 by 3.0 mm or more, that is, by providing the adjacent portion 126 of 3.0 mm or more around the first hole 124*a*, it is possible to avoid a problem that a rigidity of the adjacent portion 126 is lowered and the welding pin 60 cannot firmly be held. In other words, by setting the ratio of the minimum distance d from the first hole 124*a* to the low rigidity region 128 to the diameter D of the first hole 124*a* to 0.25 or more and providing the adjacent portion 126 of 0.25×D or more around the first hole 124*a*, it is possible to avoid a problem that the rigidity of the adjacent portion 126 is excessively lowered and the welding pin 60 cannot be held.

In addition, by not providing the first hole 124*a* away from the low rigidity region 128 by more than 10.2 mm, that is, by preventing the ratio of the minimum distance d from the first hole 124*a* to the low rigidity region 128 to the diameter D of the first hole 124*a* from exceeding 0.85, plastic deformation of the convex portion 62*a* of the welding pin 60 at a time of welding tends to be suppressed.

Although not limited, in the present embodiment, the minimum distance d from the first hole 124*a* to the low rigidity region 128 is designed in a range of 5 mm to 7 mm. In other words, the ratio of the minimum distance d from the first hole 124*a* to the low rigidity region 128 to the diameter D of the first hole 124*a* is preferably in a range of 0.42 to 0.58.

In order to verify an effect of providing the thin portion 128*a*, a comparison experiment of the holding force of the welding pin 60 press-fitted into the first hole 124*a* was conducted between a case where the thin portion 128*a* is provided in the scroll compressor 100 and a case where the thin portion 128*a* is not provided in the scroll compressor 100. The comparative experiment was performed under an equal condition except whether or not to provide the thin portion 128*a* (for example, dimensions and materials of the welding pin 60 and the main body portion 120, welding conditions, and the like and the like are set to the same in the both experiments). As a result of the experiment, an average value P2 of the holding forces of the welding pins 60 press-fitted into the first holes 124*a* in the case where the thin portion 128*a* is provided is about 1.75 times an average value P1 of the holding forces of the welding pins 60 press-fitted into the first holes 124*a* in the case where the thin portion 128*a* is not provided (P2≈1.75 P1).

(4) Operation of Scroll Compressor

Operation of the scroll compressor 100 will be described. Here, the operation of the scroll compressor 100 in a steady state (a state where the operation is started and reaches a stable state) will be described.

When the motor 70 is driven, the rotor 74 rotates, and the drive shaft 80 coupled to the rotor 74 also rotates. When the drive shaft 80 rotates, the movable scroll 40 does not rotate by itself but moves in orbit with respect to the fixed scroll 30 by means of the Oldham coupling 24. The low-pressure refrigerant in the refrigeration cycle of the refrigeration cycle apparatus 1 flowing from the suction pipe 18*a* is sucked into the peripheral edge-side compression chamber Sc of the compression mechanism 20 via the suction port 36*a*. As the volume of the compression chamber Sc decreases along with orbital motion of the movable scroll 40, the pressure in the compression chamber Sc increases. Also, the intermediate-pressure (pressure between high and low pressure) refrigerant in the refrigeration cycle of the refrigeration cycle apparatus 1 is injected into the compression chamber Sc in the midstream of compression from the injection pipe 18*c* as needed. The pressure of the refrigerant increases as the refrigerant approaches the center-side (inner side) compression chamber Sc from the peripheral edge-side (outer side) compression chamber Sc and finally becomes a high pressure in the refrigeration cycle of the refrigeration cycle apparatus 1. The refrigerant compressed by the compression mechanism 20 is discharged from the discharge port 33 located near a center of the fixed-side end plate 32, passes through the not-illustrated refrigerant passage formed through the fixed scroll 30 and the housing 50, and flows into the first space S1. The high-pressure refrigerant in the refrigeration cycle is discharged from the first space S1 through the discharge pipe 18*b*.

(5) Characteristics 5-1

The scroll compressor 100 of the present embodiment includes the motor 70 as an example of a actuator, the compression mechanism 20, the drive shaft 80, the housing 50 as an example of a support, the casing 10, and the welding pin 60. The drive shaft 80 transmits a driving force of the motor 70 to the compression mechanism 20. The housing 50 supports the bearing metal 112 (a bearing metal 112 provided in an upper bearing housing 110) as an example of a bearing that rotatably supports the drive shaft 80. At least one hole 124 is formed in the outer surface 122 of the main body portion 120 of the housing 50. The casing 10 accommodates the drive shaft 80 and the housing 50 therein. The casing 10, in particular, the cylindrical member 12, has a cylindrical shape. The concave-convex surface 64 having a concave-convex shape is provided on the outer periphery of the welding pin 60. The welding pin 60 is press-fitted into the hole 124 of the housing 50 and is welded and fixed to the casing 10. At least a part of the periphery of the adjacent portion adjacent to the hole 124 of the housing 50, particularly in the present embodiment, at least a part of the periphery of the adjacent portion 126 adjacent to a first hole 124*a*, is provided with the low rigidity region 128 having lower rigidity than the adjacent portion 126. The low rigidity region 128 includes the thin portion 128*a* having a smaller thickness in the radial direction of the casing 10 than the adjacent portion 126.

In the scroll compressor 100 of the present embodiment, the periphery of the adjacent portion 126 adjacent to the hole 124 of the housing 50 into which the welding pin 60 is press-fitted is provided with the low rigidity region 128 including the thin portion 128*a* and having lower rigidity than the adjacent portion 126. By providing the low rigidity region 128, the housing 50 can deform when the welding pin 60 is thermally expanded at a time of welding, and plastic deformation of a convex portion 62*a* of a concave-convex surface 64 of the welding pin 60 can be suppressed. As a result of suppressing the plastic deformation of the welding pin 60, a relatively large holding force of the welding pin 60 can be maintained after welding.

5-2

In the low rigidity region 128 of the scroll compressor 100 of the present embodiment, the downgage 129 is formed closer to a center axis O of the casing 10 than the outer surface 122 of the main body portion 120 of the housing 50.

In the scroll compressor 100 of the present embodiment, by forming the downgage 129 around the adjacent portion 126, it is possible to suppress plastic deformation of the convex portion 62*a* of the concave-convex surface 64 of the welding pin 60 when the welding pin 60 is thermally expanded.

5-3

In the scroll compressor 100 of the present embodiment, when the hole 124 (the first hole 124*a* in the present embodiment) is viewed from a position just facing the hole 124, the low rigidity region 128 is provided in a region at 180° or more around a center of the first hole 124*a*.

In the scroll compressor 100 of the present embodiment, by providing the low rigidity region 128 in the region at 180° or more around the center of the first hole 124*a*, the housing 50 can deform when the welding pin 60 is thermally expanded and plastic deformation of the convex portion 62*a* of the concave-convex surface 64 of the welding pin 60 may be suppressed.

5-4

In the scroll compressor 100 of the present embodiment, the ratio (=d/D) of the minimum distance d from the hole 124 (the first hole 124*a* in the present embodiment) to the low rigidity region 128 to the diameter D of the first hole 124*a* is 0.25 or more and 0.85 or less.

By setting the ratio (=d/D) of the minimum distance d from the first hole 124*a* to the low rigidity region 128 to the diameter D of the first hole 124*a* to 0.25 or more, the scroll compressor 100 of the present embodiment can maintain a strength of the housing 50 holding the welding pin 60.

Further, in the scroll compressor 100 of the present embodiment, the ratio (=d/D) of the minimum distance d from the first hole 124*a* to the low rigidity region 128 to the diameter D of the first hole 124*a* is 0.85 or less. In other words, in the scroll compressor 100 of the present embodiment, the low rigidity region 128 is disposed relatively close to the first hole 124*a*. As a result, when the welding pin 60 is thermally expanded, the housing 50 can deform, and plastic deformation of the convex portion 62*a* of the concave-convex surface 64 of the welding pin 60 can be suppressed.

5-5

In the scroll compressor 100 of the present embodiment, the plurality of holes 124 are disposed in an axial direction of the drive shaft 80. In the present embodiment, the first hole 124*a* and the second hole 124*b* are provided in the axial direction of the drive shaft 80. In the present embodiment, the low rigidity region 128 having lower rigidity than the adjacent portion 126 is provided at least a part of the periphery of the adjacent portion 126 (an example of the first adjacent portion) adjacent to the first hole 124*a* disposed closest to the bearing metal 112 in the axial direction of the drive shaft 80 among the holes.

In the scroll compressor 100 of the present embodiment, the low rigidity region 128 is provided at least around the first hole 124*a* where the welding pin 60 may receive a largest force (moment) during operation of the compressor. As a result, it is possible to suppress lowering of the holding force of the welding pin 60 press-fitted into the first hole 124*a* after welding.

5-6

The compressor of the present embodiment is the scroll compressor 100, and the housing 50 supports the bearing (bearing metal 112) disposed closer to the compression mechanism 20 than the motor 70.

The scroll compressor 100 of the present embodiment can suppress lowering of the holding force of the welding pin 60 after welding, which is used for the housing 50 of the scroll compressor 100 on which a large force tends to act.

5-7

In the scroll compressor 100 of the present embodiment, the low rigidity region 128 includes the thin portion 128*a* as an example of a first portion and the void portion 128*b* as an example of a second portion. The thin portion 128*a* is disposed, so as to interpose the first hole 124*a*, on both sides of the first hole 124*a* in a circumferential direction of the cylindrical member 12 of the casing 10. The void portion 128*b* is disposed closer to the motor 70 than the first hole 124*a* in the axial direction of the drive shaft 80.

In the scroll compressor 100 of the present embodiment, as the low rigidity region 128 is disposed so as to surround the first hole 124*a* on three sides, the housing 50 can deform relatively largely when the welding pin 60 is thermally expanded and it is possible to suppress plastic deformation of the convex portion 62*a* of the concave-convex surface 64 of the welding pin 60.

5-8

In the scroll compressor 100 of the present embodiment, the downgage 129 is disposed, so as to interpose the first hole 124*a*, on both sides of the first hole 124*a* in the circumferential direction of the cylindrical member 12 of the casing 10. The welding pin 60 has the first length L in the radial direction of the cylindrical member 12 of the casing 10. In other words, the welding pin 60 has the first length L in the press-fitting direction. In the radial direction of the casing 10, the region where the downgage 129 exists and the region where the welding pin 60 exists overlap with each other in a range of 10% or more of the first length L.

In the scroll compressor 100 of the present embodiment, in the radial direction of the casing 10, the region where the downgage 129 exists and the region where the welding pin 60 exists overlap with each other in the range of 10% or more of the first length L of the welding pin 60. Therefore, plastic deformation of the convex portion 62*a* of the concave-convex surface 64 of the welding pin 60 is easily suppressed when the welding pin 60 is thermally expanded.

(6) Modification Examples

Modification examples of the above-described embodiment will be described below. Alternatively, the following modification examples may appropriately be combined insofar as there are no inconsistencies.

(6-1) Modification Example A

In the above embodiment, the compressor has been described by taking the scroll compressor 100 as an example, but the type of compressor is not limited to the scroll compressor. The configuration of the present disclosure in which the low rigidity region is provided in the support that supports the bearing that rotatably supports the drive shaft is widely applicable to a compressor in which a hole for press-fitting a welding pin is provided in a support, and the welding pin and a casing are fixed by welding. For example, the compressor of the present disclosure may be a rotary compressor.

(6-2) Modification Example B

In the above embodiment, the thin portion 128*a* is provided on both sides of the first hole 124*a* of the main body portion 120 of the housing 50 in the circumferential direction of the cylindrical member 12 of the casing 10. On the other hand, the thin portion 128*a* is not provided on both sides of the second hole 124*b* (the hole disposed above the first hole 124*a*) of the main body portion 120 of the housing 50. However, the present invention is not limited thereto, and for example, the thin portion 128*a* may be provided on both sides of the adjacent portion of the second hole 124*b* of the main body portion 120 of the housing 50 in the circumferential direction of the cylindrical member 12 of the casing 10 by increasing a depth of the downgage 129. With this configuration, similarly, when the welding pin 60 press-fitted into the second hole 124*b* is thermally expanded at the time of welding to the casing 10, the housing 50 can be deformed to suppress plastic deformation of the convex portion 62*a* of the concave-convex surface 64 of the welding pin 60.

(6-3) Modification Example C

In the above embodiment, in the main body portion 120 of the housing 50, the holes 124 are provided at two positions in the axial direction of the drive shaft 80 at each of four locations in the circumferential direction of the cylindrical member 12 of the casing 10.

However, the present invention is not limited thereto, and for example, in the main body portion 120 of the housing 50, the hole 124 may be provided at only one position at each of four locations in the circumferential direction of the cylindrical member 12 of the casing 10. For example, the welding pins 60 press-fitted into the second hole 124*b* and the second hole 124*b* in the above embodiment may be omitted.

Alternatively, in the main body portion 120 of the housing 50, three or more holes 124 may be provided at each of four locations in the circumferential direction of the cylindrical member 12 of the casing 10. In this case, at least a part of the periphery of the adjacent portion adjacent to the hole 124 disposed closest to the bearing metal 112 in the axial direction of the drive shaft 80 among the holes 124 is preferably provided with the low rigidity region having lower rigidity than the adjacent portion.

(6-4) Modification Example D

In the above embodiment, in the main body portion 120 of the housing 50, the holes 124 are provided at two positions in the axial direction of the drive shaft 80 so that the holes 124 are arrayed in the axial direction of the drive shaft 80 at each of four locations in the circumferential direction of the cylindrical member 12 of the casing 10.

However, the present invention is not limited thereto, and for example, the hole 124 disposed on the lower side of the main body portion 120 of the housing 50 (the first hole 124*a* in the above embodiment) and the hole 124 disposed on the upper side of the main body portion 120 of the housing 50 (the second hole 124*b* in the above embodiment) may be disposed at different positions in the circumferential direction of the cylindrical member 12 of the casing 10.

(6-5) Modification Example E

In the above embodiment, the thin portion 128*a* of the low rigidity region 128 is formed by forming the downgage 129 closer to the center axis O of the casing 10 than the outer surface 122 of the housing 50. However, a method of forming the thin portion 128*a* is not limited thereto.

Figure 9:
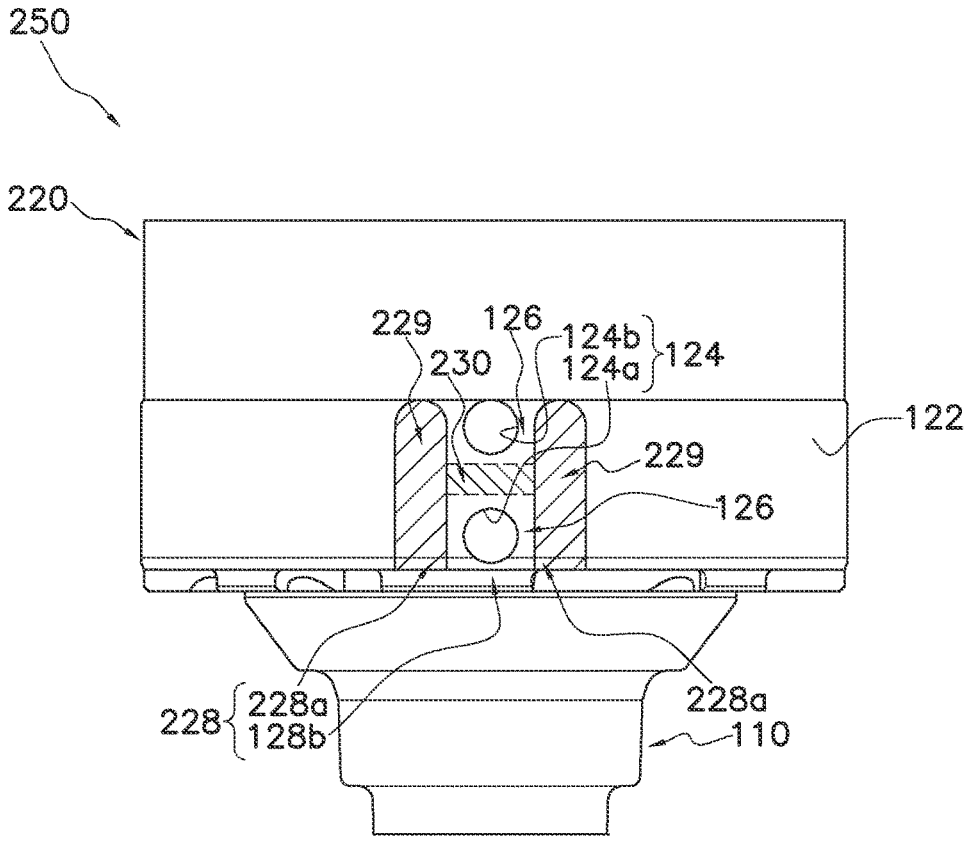
FIG. 9 is a schematic side view of a housing of a scroll compressor according to a modification example E.

For example, as in a housing 250 illustrated in FIG. 9, a thin portion 228*a* may be provided by providing a groove 229 on the outer surface 122 of the main body portion 220 of the housing 250 instead of the downgage 129. Here, the groove 229 is provided on both sides of the hole 124 (the first hole 124*a* and the second hole 124*b*) in the circumferential direction of the cylindrical member 12 of the casing 10 so as to interpose the hole 124. The groove 229 is recessed radially inward of the casing 10 with respect to the outer surface 122 of the main body portion 220 and extends along the axial direction of the drive shaft 80.

As a result of forming the groove 229, a thickness of the thin portion 228*a* in the radial direction of the cylindrical member 12 of the casing 10 (a thickness of a portion where a member exists between the outer surface 122 of the main body portion 120 and the crank chamber 52) is smaller than the minimum thickness K of the adjacent portion 126.

In the thin portion 228*a* of the present embodiment, a thickness from a bottom portion of the groove 229 to a position where the bottom portion 125 of the hole 124 exists is smaller than the depth A of the hole 124 in the radial direction of the cylindrical member 12 of the casing 10. In short, in the adjacent portion 126, in the radial direction of the cylindrical member 12 of the casing 10, a member having the thickness A exists from the position where the bottom portion 125 of the hole 124 to the outer surface 122 of the main body portion 120, whereas a thickness from the position where the bottom portion 125 of the hole 124 exists to the bottom portion of the groove 229 of the thin portion 228*a* is smaller than the thickness A. In other words, in the radial direction of the cylindrical member 12 of the casing 10, the thickness of the thin portion 228*a* existing further on an outer side than the position of the bottom portion 125 of the hole 124 is thinner than the depth A of the hole 124 by a depth of the groove 229 in the radial direction of the cylindrical member 12 of the casing 10.

In the radial direction of the cylindrical member 12 of the casing 10, a region where the groove 229 exists and the region where the welding pin 60 press-fitted into the hole 124 exists preferably overlap with each other in a range of 10% or more of the length of the welding pin 60 press-fitted into the hole 124 in the radial direction of the cylindrical member 12 of the casing 10 (in other words, the length L of the welding pin 60 in the press-fitting direction). Here, it is assumed that the welding pin 60 is press-fitted to a position where the welding pin abuts against the bottom portion 125 of the hole 124.

The low rigidity region 228 provided in the main body portion 220 of the housing 250 of the present modification includes the void portion 128*b* in addition to the thin portion 228*a*. Description of the void portion 128*b* is omitted since the void portion 128*b* is similar to that in the above embodiment.

In a case where the thin portion 228*a* and the void portion 128*b* are provided in the main body portion 220 as in the present modification example, as well as in the above embodiment, when the welding pin 60 is thermally expanded at the time of welding to the casing 10, the housing 250 can be deformed to suppress plastic deformation of the convex portion 62*a* of the concave-convex surface 64 of the welding pin 60. As a result of suppressing the plastic deformation of the convex portion 62*a* of the concave-convex surface 64 of the welding pin 60, a relatively large holding force of the welding pin 60 after welding can be maintained.

Further, in the present modification example, by forming the groove 229 extending to a side of the second hole 124*b* to provide the thin portion 228*a*, when the welding pin 60 press-fitted into the second hole 124*b* is thermally expanded at the time of welding to the casing 10, the housing 250 can be deformed to suppress plastic deformation of the convex portion 62*a* of the concave-convex surface 64 of the welding pin 60. As a result, as for not only the welding pin 60 press-fitted into the first hole 124*a* but also the welding pin 60 press-fitted into the second hole 124*b*, a relatively large holding force of the welding pin 60 after welding can be maintained.

For example, in the housing of the scroll compressor 100, as the low rigidity region, the thin portion 128*a* formed by providing the downgage 129 as in the above embodiment and the thin portion 228*a* formed by providing the groove 229 as in the present modification example may be mixed.

Further, on the outer surface 122 of the main body portion 220 of the housing 250, for example, a groove 230 may further be provided along the circumferential direction of the cylindrical member 12 of the casing 10 between the first hole 124*a* and the second hole 124*b* (refer to a broken line in FIG. 9). By providing the groove 230 in this manner, plastic deformation of the convex portion 62*a* of the concave-convex surface 64 of the welding pin 60 press-fitted into the first hole 124*a* and the second hole 124*b* tends to be further suppressed.

(6-6) Modification Example F

In the above embodiment, the housing 50 is fixed by press fitting and welding. However, the present invention is not limited thereto, and for example, the housing 50 may be fixed to the casing 10 only by welding (only by welding of the welding pin 60 press-fitted into the hole 124 of the main body portion 120 and the casing 10).

(6-7) Modification Example G

In the above embodiment, the vertical scroll compressor in which the axial direction of the drive shaft 80 is a vertical direction is described as an example, but the compressor may be a horizontal compressor in which the axial direction of the drive shaft 80 is a horizontal direction.

(6-8) Modification Example H

In the scroll compressor 100 of the above embodiment, when the first hole 124*a* is viewed from a position just facing the first hole 124*a*, the low rigidity region 128 is provided in the region at 180° or more around the center of the first hole 124*a*, but the present invention is not limited thereto. The low rigidity region 128 may be provided in a region smaller than the region at 180° around the center of the first hole 124*a*. However, by providing, the low rigidity region 128 in the region at 180° or more around the center of the first hole 124*a* when the first hole 124*a* is viewed from a position just facing the first hole 124*a*, plastic deformation of the convex portion 62*a* of the concave-convex surface 64 of the welding pin 60 press-fitted into the first hole 124*a* tends to be particularly suppressed.

(6-9) Modification Example I

In the above embodiment, the housing 50 and the lower bearing housing 90 support the bearing metal 112 and the bearing metal 91 as examples of bearings, respectively, but the present invention is not limited thereto. For example, the housing 50 and the lower bearing housing 90 may support roller bearings such as ball bearings instead of the bearing metals 112 and 91.

(6-10) Modification Example J

Figure 11:
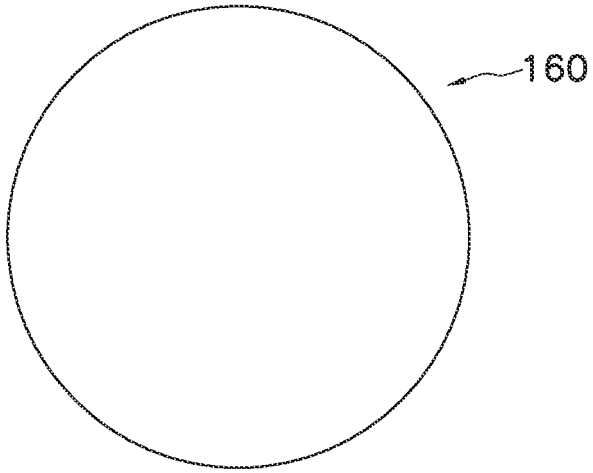
FIG. 11 is a view of the welding pin before being press-fitted used in a scroll compressor according to a modification example J, as viewed along the press-fitting direction of the welding pin.

In the above embodiment, the scroll compressor of the present disclosure is described by taking, as an example, a case where the welding pin 60 has the concave-convex surface 64 having a concave-convex shape on the outer periphery. However, for example, the welding pin before press-fitting used in the scroll compressor of the present disclosure may be a cylindrical welding pin 160 not having the concave-convex surface 64. In other words, as illustrated in FIG. 11, for example, the welding pin 160 before press-fitting may have a circular shape when viewed along the press-fitting direction.

A scroll compressor according to the modification example J described herein is similar to the scroll compressor of the above embodiment except for the welding pin 160.

In short, a configuration similar to the configuration described in the above embodiment will be described using the same reference signs as those used to describe the above embodiment. A scroll compressor 100 of the modification example J includes a motor 70, a compression mechanism 20, a drive shaft 80, a housing 50, a casing 10, and a welding pin 160. The drive shaft 80 transmits a driving force of the motor 70 to the compression mechanism 20. The housing 50 supports a bearing metal 112, provided in an upper bearing housing 110, that rotatably supports the drive shaft 80. At least one hole 124 is formed in an outer surface 122 of a main body portion 120 of the housing 50. The casing 10 accommodates the drive shaft 80 and the housing 50 therein. The casing 10, in particular, a cylindrical member 12, has a cylindrical shape. The welding pin 160 is press-fitted into the hole 124 of the housing 50 and is welded and fixed to the casing 10. A low rigidity region 128 is provided at least a part of a periphery of an adjacent portion adjacent to the hole 124 of the housing 50, particularly in the present embodiment, at least a part of a periphery of an adjacent portion 126 adjacent to a first hole 124*a*. The low rigidity region 128 has lower rigidity than the adjacent portion 126. The low rigidity region 128 includes a thin portion 128*a* having a smaller thickness in a radial direction of the casing 10 than the adjacent portion 126.

With such a configuration, in the scroll compressor 100 of the modification example J, the housing 50 can deform when the welding pin 160 is thermally expanded during welding, and excessive plastic deformation of the welding pin 160 can be suppressed. As a result of suppressing the plastic deformation of the welding pin 160, a relatively large holding force of the welding pin 160 after welding can be maintained.

Although not described in detail herein, the scroll compressor 100 according to the modification example J preferably has the characteristics described in (5-2) to (5-8) of the above embodiment except that the welding pin 160 does not have the concave-convex surface.

SUPPLEMENTARY NOTE

The embodiment of the present disclosure has been described above. It will be understood that various changes to modes and details can be made without departing from the spirit and scope of the present disclosure recited in the claims.

The present disclosure is widely applicable and useful to a compressor in which a welding pin is press-fitted into a hole on an outer surface of a support that supports a bearing, and the welding pin and a casing are welded and fixed.

The invention claimed is:

1. A compressor comprising:

an actuator;

a compression mechanism;

a drive shaft configured to transmit a driving force of the actuator to the compression mechanism;

a support supporting a bearing configured to rotatably support the drive shaft, the support having at least one hole formed in an outer surface thereof;

a casing having a cylindrical shape and accommodating the drive shaft and the support therein; and a welding pin being press-fitted into the at least one hole of the support and welded and fixed to the casing, a low rigidity region being provided at at least a part of a periphery of an adjacent portion adjacent to the at least one hole of the support, the low rigidity region having lower rigidity than the adjacent portion, and the low rigidity region including a thin portion having a smaller thickness in a radial direction of the casing than the adjacent portion.

2. The compressor according to claim 1, wherein,
in the low rigidity region, a downgage is formed closer to a center axis of the casing than the outer surface of the support.

3. The compressor according to claim 2, wherein,
when the at least one hole is viewed from a position just facing the at least one hole, the low rigidity region is provided in a region at 180° or more around a center of the at least one hole.

4. The compressor according to claim 2, wherein
a ratio of
a minimum distance from the at least one hole to the low rigidity region to
a diameter of the at least one hole is 0.25 or more and 0.85 or less.

5. The compressor according to claim 2, wherein
the at least one hole includes a plurality of holes that are disposed along an axial direction of the drive shaft, and
the low rigidity region is provided at at least a part of a periphery of a first adjacent portion adjacent to a first hole disposed closest to the bearing in the axial direction of the drive shaft of the plurality of holes, the low rigidity region having lower rigidity than the first adjacent portion.

6. The compressor according to claim 2, wherein
the compressor is a scroll compressor, and
the support supports the bearing disposed closer to the compression mechanism than the actuator.

7. The compressor according to claim 2, wherein
the low rigidity region includes
a first portion disposed, so as to interpose the at least one hole, on both sides of the at least one hole in a circumferential direction of the casing, and
a second portion disposed closer to the actuator than the at least one hole in the axial direction of the drive shaft.

8. The compressor according to claim 2, wherein
the downgage is disposed, so as to interpose the at least one hole, on both sides of the at least one hole in a circumferential direction of the casing,
the welding pin has a first length in a radial direction of the casing, and
in the radial direction of the casing, a region where the downgage exists and a region where the welding pin exists overlap with each other in a range of 10% or more of the first length.

9. The compressor according to claim 2, wherein
the welding pin has a concave-convex surface having a concave-convex shape on an outer periphery thereof.

10. A refrigeration cycle apparatus comprising:
a refrigerant circuit including the compressor according to claim 2.

11. The compressor according to claim 1, wherein,
when the at least one hole is viewed from a position just facing the at least one hole, the low rigidity region is provided in a region at 180° or more around a center of the at least one hole.

12. The compressor according to claim 1, wherein
a ratio of
a minimum distance from the at least one hole to the low rigidity region to
a diameter of the at least one hole is 0.25 or more and 0.85 or less.

13. The compressor according to claim 1, wherein
the at least one hole includes a plurality of holes are disposed along an axial direction of the drive shaft, and
the low rigidity region is provided at at least a part of a periphery of a first adjacent portion adjacent to a first hole disposed closest to the bearing in the axial direction of the drive shaft of the plurality of holes, the low rigidity region having lower rigidity than the first adjacent portion.

14. The compressor according to claim 1, wherein
the compressor is a scroll compressor, and
the support supports the bearing disposed closer to the compression mechanism than the actuator.

15. The compressor according to claim 1, wherein
the low rigidity region includes
a first portion disposed, so as to interpose the at least one hole, on both sides of the at least one hole in a circumferential direction of the casing, and
a second portion disposed closer to the actuator than the at least one hole in the axial direction of the drive shaft.

16. The compressor according to claim 1, wherein
the welding pin has a concave-convex surface having a concave-convex shape on an outer periphery thereof.

17. A refrigeration cycle apparatus comprising:
a refrigerant circuit including the compressor according to claim 1.

* * * * *